US007665815B2

(12) United States Patent
Swett et al.

(10) Patent No.: US 7,665,815 B2
(45) Date of Patent: Feb. 23, 2010

(54) DROPLET EJECTION APPARATUS ALIGNMENT

(75) Inventors: David A. Swett, North Sutton, NH (US); Daniel Cote, Windsor, VT (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 242 days.

(21) Appl. No.: 11/118,293

(22) Filed: Apr. 29, 2005

(65) Prior Publication Data

US 2005/0270329 A1 Dec. 8, 2005

Related U.S. Application Data

(60) Provisional application No. 60/566,729, filed on Apr. 30, 2004.

(51) Int. Cl.
*B41J 29/38* (2006.01)

(52) U.S. Cl. ..... 347/9

(58) Field of Classification Search ..... 347/42, 347/49, 13, 108, 363–366
See application file for complete search history.

(56) References Cited

U.S. PATENT DOCUMENTS

| | | | | |
|---|---|---|---|---|
| 4,433,341 | A | | 2/1984 | Thomas |
| 4,527,175 | A | | 7/1985 | Kojima et al. |
| 4,529,445 | A | | 7/1985 | Buschow |
| 4,661,458 | A | | 4/1987 | Berry et al. |
| 4,680,696 | A | | 7/1987 | Eminuma et al. |
| 4,825,227 | A | | 4/1989 | Fischbeck et al. |
| 4,929,963 | A | | 5/1990 | Balazar |
| 4,937,598 | A | | 6/1990 | Hine et al. |
| 4,940,998 | A | | 7/1990 | Asakawa |
| 5,265,315 | A | | 11/1993 | Hoisington et al. |
| 5,365,843 | A | | 11/1994 | House et al. |
| 5,461,405 | A | * | 10/1995 | Lehmann et al. ..... 349/49 |
| 5,489,930 | A | | 2/1996 | Anderson |
| 5,546,109 | A | | 8/1996 | Nakano |
| 5,610,645 | A | | 3/1997 | Moore et al. |
| 5,646,658 | A | * | 7/1997 | Thiel et al. ..... 347/49 |
| 5,724,082 | A | | 3/1998 | Moynihan |

(Continued)

FOREIGN PATENT DOCUMENTS

CN 1980795 A 6/2007

(Continued)

OTHER PUBLICATIONS

International Search Report for PCT/US2005/015028, Aug. 22, 2005.

(Continued)

*Primary Examiner*—Matthew Luu
*Assistant Examiner*—Justin Seo
(74) *Attorney, Agent, or Firm*—Fish & Richardson P.C.

(57) ABSTRACT

In one aspect, the invention features assemblies for depositing droplets on a substrate during relative motion of the assembly and the substrate along a process direction. The assemblies include a first printhead module and a second printhead module contacting the first printhead module, each of the printhead modules including a surface that includes an array of nozzles through which the printhead modules can eject fluid droplets, wherein each nozzle in the first printhead module's nozzle array is offset with respect to a corresponding nozzle in the second printhead module's nozzle array in a direction orthogonal to the process direction.

27 Claims, 17 Drawing Sheets

U.S. PATENT DOCUMENTS

| | | | | |
|---|---|---|---|---|
| 5,751,300 | A | 5/1998 | Cowger et al. | |
| 5,782,184 | A * | 7/1998 | Albertalli et al. | 101/486 |
| 5,831,654 | A | 11/1998 | Colombat et al. | |
| 5,885,455 | A | 3/1999 | Graus et al. | |
| 5,936,650 | A | 8/1999 | Ouchida et al. | |
| 5,939,816 | A * | 8/1999 | Culp | 310/328 |
| 6,000,792 | A | 12/1999 | Koizumi et al. | |
| 6,068,367 | A | 5/2000 | Fabbri et al. | |
| 6,084,618 | A | 7/2000 | Baker | |
| 6,152,559 | A | 11/2000 | Kojima et al. | |
| 6,217,164 | B1 | 4/2001 | Hino | |
| 6,391,193 | B1 | 5/2002 | Luka | |
| 6,406,137 | B1 | 6/2002 | Okazaki et al. | |
| 6,428,141 | B1 | 8/2002 | McElfresh et al. | |
| 6,457,811 | B1 | 10/2002 | Pan et al. | |
| 6,467,874 | B1 * | 10/2002 | Williams et al. | 347/42 |
| 6,499,823 | B2 | 12/2002 | Okazaki et al. | |
| 6,554,398 | B2 | 4/2003 | Wyngaert et al. | |
| 6,634,742 | B2 | 10/2003 | Owaki et al. | |
| 6,652,083 | B2 | 11/2003 | Ison et al. | |
| 6,655,786 | B1 | 12/2003 | Foote et al. | |
| 6,659,590 | B2 | 12/2003 | Silverbrook | |
| 6,672,706 | B2 | 1/2004 | Silverbrook | |
| 6,672,707 | B2 | 1/2004 | Silverbrook | |
| 6,685,299 | B2 | 2/2004 | Hirota | |
| 6,715,863 | B2 | 4/2004 | Shimizu | |
| 6,752,493 | B2 | 6/2004 | Dowell et al. | |
| 6,796,630 | B2 | 9/2004 | Ison et al. | |
| 6,869,167 | B2 | 3/2005 | Silverbrook | |
| 7,052,117 | B2 | 5/2006 | Bibl et al. | |
| 7,413,284 | B2 | 8/2008 | Hoisington et al. | |
| 7,413,300 | B2 | 8/2008 | von Essen | |
| 7,448,741 | B2 | 11/2008 | von Essen | |
| 7,566,118 | B2 | 7/2009 | Bibl et al. | |
| 2002/0024554 | A1 | 2/2002 | Tominaga | |
| 2002/0180835 | A1 | 12/2002 | Boyd et al. | |
| 2003/0202040 | A1 * | 10/2003 | Shade | 347/40 |
| 2003/0227516 | A1 | 12/2003 | Yamaguchi et al. | |
| 2003/0234845 | A1 | 12/2003 | Tominaga et al. | |
| 2004/0021735 | A1 | 2/2004 | Horii et al. | |
| 2004/0224102 | A1 * | 11/2004 | Ebihara | 428/32.1 |
| 2005/0157073 | A1 | 7/2005 | Silverbrook et al. | |
| 2005/0243127 | A1 | 11/2005 | Higginson et al. | |
| 2005/0270329 | A1 | 12/2005 | Hoisington et al. | |
| 2005/0280678 | A1 | 12/2005 | Bibl et al. | |
| 2006/0250493 | A1 * | 11/2006 | Silverbrook et al. | 347/148 |
| 2008/0211872 | A1 | 9/2008 | Hoisington et al. | |

FOREIGN PATENT DOCUMENTS

| | | | |
|---|---|---|---|
| CN | 1984780 | A | 6/2007 |
| CN | 1997521 | A | 7/2007 |
| EP | 0 383 558 | | 8/1990 |
| EP | 0666177 | | 8/1995 |
| EP | 1186416 | | 3/2002 |
| EP | 1 238 813 | | 9/2002 |
| EP | 1 258 354 | A2 | 11/2002 |
| EP | 1 336 486 | | 8/2003 |
| EP | 1747098 | | 1/2007 |
| EP | 1748895 | | 2/2007 |
| EP | 1748897 | | 2/2007 |
| JP | 2003127385 | A * | 5/2003 |
| JP | P2003-127385 | A | 5/2003 |
| JP | 2007511058 | | 4/2007 |
| JP | 2007-535434 | | 12/2007 |
| JP | 2007535431 | | 12/2007 |
| JP | 2007535433 | | 12/2007 |
| KR | 20070007202 | | 1/2007 |
| KR | 20070007379 | | 1/2007 |
| KR | 20070012846 | | 1/2007 |
| WO | 2005108094 | | 11/2005 |
| WO | 2005108095 | | 11/2005 |
| WO | 2005108097 | A | 11/2005 |

OTHER PUBLICATIONS

International Search Report received in PCT application No. PCT/US2005/014999, mailed Oct. 6, 2005.
U.S. Appl. No. 10/189,947, filed Jul. 3, 2002, Bibl et al.
U.S. Appl. 10/836,456, filed Apr. 30, 2004, von Essen.
U.S. Appl. 60/510, 459, filed Oct. 10, 2003, Chen et al.
U.S. Appl. 60/566,729, filed Apr. 30, 2004, von Essen et al.
U.S. Appl. 60/567,035, filed Apr. 30, 2004, von Essen et al.
U.S. Appl. 60/567,070, filed Apr. 30, 2004, Higginson et al.
U.S. Appl. 12/058,139, filed Mar. 28, 2008, Hoisington et al.
Office Action dated Dec. 26, 2008 in corresponding Chinese Application No. 200580017004.X.
Pending claims from related U.S. Appl. No. 11/118,704.
PAIR Transaction History from related U.S. Appl. No. 11/118,704.
Pending claims from U.S. Appl. No. 12/058,139.
PAIR Transaction History from U.S. Appl. No. 12/058,139.
Office Action from related Chinese Application No. 200580019821.9 dated Sep. 12, 2008.
International Preliminary Report on Patentability from PCT/US2005/014999 dated Nov. 9, 2006.
International Preliminary Report on Patentability from PCT/US2005/015028 dated Nov. 9, 2006.
International Search Report for PCT/US2005/015028, Dec. 6, 2005.
International Preliminary Report on Patentability from International Application No. PCT/US2005/14952 dated Nov. 9, 2006.
PAIR Transaction History for USSN 11/118,704 retrieved from the patent office public PAIR website on Nov. 4, 2009.
PAIR Transaction History for USSN 12/058,139 retrieved from the patent office public PAIR website on Nov. 3, 2009.

* cited by examiner

DROPLET EJECTION APPARATUS ALIGNMENT

CROSS-REFERENCE TO RELATED APPLICATIONS

This application claims priority under 35 USC §119(e)(1) to Provisional Patent Application No. 60/566,729, entitled "DROPLET EJECTION APPARATUS ALIGNMENT," filed on Apr. 30, 2004, the entire contents of which are incorporated herein by reference.

TECHNICAL FIELD

This invention relates to droplet ejection devices, and more particularly to alignment of the droplet ejection devices.

BACKGROUND

Examples of droplet ejection devices include ink jet printers. Ink jet printers typically include an ink path from an ink supply to a nozzle path in a printhead module. The nozzle path terminates in a nozzle opening in a surface of the printhead module from which ink drops are ejected. Ink drop ejection is controlled by pressurizing ink in the ink path with an actuator, which may be, for example, a piezoelectric deflector, a thermal bubble jet generator, or an electro statically deflected element. A typical printhead module has an array of ink paths with corresponding nozzle openings and associated actuators, and drop ejection from each nozzle opening can be independently controlled. In a drop-on-demand printhead module, each actuator is fired to selectively eject a drop at a specific pixel location of an image as the printhead module and a printing substrate are moved relative to one another. In high performance printhead modules, the nozzle openings typically have a diameter of 50 micron or less, e.g., around 25 microns, are separated at a pitch corresponding to 100-600 nozzles/inch or more, have a resolution of 100 to 600 dpi or more, and provide drop sizes of about 1 to 70 picoliters (pl) or less. Drop ejection frequency is typically 10 kHz or more.

Hoisington et al. U.S. Pat. No. 5,265,315, the entire contents of which is hereby incorporated by reference, describes a printhead module that has a semiconductor printhead module body and a piezoelectric actuator. The printhead module body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path.

Printing accuracy is influenced by a number of factors, including the size and velocity uniformity of drops ejected by the nozzles in the head, as well as the alignment of the head relative to the printing substrate. In printers utilizing multiple printhead modules, head alignment accuracy is critical to printing accuracy as errors in alignment between printhead modules or between printhead modules and other components of a droplet ejection device can result in erroneous droplet placement relative to droplets from different printhead modules in addition to erroneous drop placement relative to the substrate.

In many applications, particularly in droplet deposition devices utilizing multiple printhead modules, printhead modules are aligned by iteratively adjusting a printhead module's position and checking nozzle location either by direct optical inspection of the printhead module or by printing and examining a test image. This procedure is repeated whenever a printhead module is removed or replaced.

SUMMARY

In general, in a first aspect, the invention features assemblies for mounting a printhead module in an apparatus for depositing droplets on a substrate. The assemblies include a frame having an opening extending through the frame and configured to expose a surface of the printhead module mounted in the assembly, and a spring element adapted to spring load the printhead module against an edge of the opening when the printhead module is mounted in the assembly.

Embodiments of the assemblies can include one or more of the following features and/or features of other aspects of the invention. The surface of the printhead module can include an array of nozzles through which droplets are ejected and the spring element can be adapted to spring load the printhead module against the frame by applying a mechanical force to the printhead module in a direction orthogonal droplet ejection direction. The spring element can include a flexure. The frame can include a plate formed to include the opening and the flexure. The plate can be a metallic plate. The plate can be formed from stainless steel, invar, or alumina. The flexure can be attached to the plate by a fastener, such as a screw, a bolt, a pin, or a rivet. In some embodiments, the spring element includes a coiled spring. The frame can include a plate and the coiled spring can be attached to the plate. The edge of the opening in the frame can include an alignment datum for precisely positioning a droplet ejection device mounted in the assembly with respect to the assembly along an axis. The spring element can be located on the opposite side of the opening from the alignment datum. The alignment datum can include a precision surface that contacts the printhead module when the droplet ejection device is mounted in the assembly. The precision surface can be offset from other portions of the opening's edge. The frame can further include one or more additional openings extending through the frame, each opening being configured to receive a corresponding printhead module. The assembly can also include one or more additional spring elements each corresponding to the one or more additional openings and each being adapted to spring load the corresponding printhead module against an edge of the respective opening when the corresponding printhead module is mounted in the assembly. The assembly can include the printhead module.

In another aspect, the invention features droplet deposition systems that include the assembly and a substrate carrier configured to position the substrate relative to the assembly so that the printhead module can deposit droplets onto the substrate.

In general, in another aspect, the invention features assemblies for depositing droplets on a substrate during relative motion of the assembly and the substrate along a process direction. The assemblies include a first printhead module and a second printhead module contacting the first printhead module, each of the printhead modules including a surface that includes an array of nozzles through which the printhead modules can eject fluid droplets, wherein each nozzle in the first printhead module's nozzle array is offset with respect to a corresponding nozzle in the second printhead module's nozzle array in a direction orthogonal to the process direction.

Embodiments of the assemblies can include one or more of the following features and/or features of other aspects of the invention. Each nozzle in the first printhead module's nozzle array can be offset by an amount less than the spacing of adjacent nozzles in the nozzle array. The first printhead module can include at least one alignment datum that contacts a corresponding alignment datum on the second printhead module. The alignment datum of the first printhead module can include a precision surface offset from the adjacent region of the first printhead module. The array of nozzles in the surfaces of the first and second printhead modules can each include a row of regularly spaced nozzles. The assembly can further include one or more additional printhead modules, each additional printhead module being coupled to the first and second printhead modules by the clamp. Each additional printhead module can contacts at least one other printhead module. In some embodiments, the assembly can further include a fluid supply configured to supply the first and second printhead modules with a fluid. The assembly can include a frame having an opening extending through the frame and configured to expose the surfaces of the first and second printhead modules when the printhead modules are mounted in the frame. The assembly can include a clamp securing the first printhead module to the second printhead module.

In general, in another aspect, the invention features assemblies for depositing droplets on a substrate as the apparatus and the substrate move relative to each other along a process direction, the assemblies including a first printhead module and a second printhead module, each of the printhead modules including a surface that has an array of nozzles through which the printhead modules can eject droplets, the first and second printhead modules being arranged so that each nozzle in the first printhead module's nozzle array is offset with respect to a corresponding nozzle in the second printhead module's nozzle array in a direction orthogonal to the process direction, each of the printhead modules further including at least one alignment datum, wherein at least one alignment datum of the first printhead module contacts at least one alignment datum of the second printhead module. Embodiments of the assemblies can include features of other aspects of the invention.

In general, in another aspect, the invention features assemblies for mounting a printhead module in an apparatus for depositing droplets on a substrate. The assemblies include a frame having an opening extending through the frame and configured to expose a surface of the printhead module mounted in the assembly, wherein the surface includes an array of nozzles through which the printhead module can eject droplets, and a clamp element attached to the frame and adapted to press the printhead module against an edge of the opening when the printhead module is mounted in the assembly.

Embodiments of the assemblies can include one or more of the following features and/or features of other aspects of the invention. The clamp element can press the printhead module against the edge of the opening in the direction the nozzle array. The clamp element can press the printhead module against the edge of the opening in a direction orthogonal to the array of nozzles. The frame can include a plate formed to include the opening and the clamp element is secured to the plate by a fastener. The plate can be a metallic plate. The plate can be formed from stainless steel, invar, or alumina. The clamp element can include a mechanical actuator, wherein adjusting the mechanical actuator varies a force with which the clamping element presses the printhead module against the opening edge. The edge of the opening in the frame can include at least one alignment datum for precisely positioning the printhead module mounted in the assembly with respect to the assembly along an axis. The clamp element can be attached to the frame on the opposite side of the opening from the alignment datum. The alignment datum can include a precision surface that contacts the droplet ejection device when the droplet ejection device is mounted in the assembly. The precision surface can be offset from other portions of the opening's edge. The frame can include one or more additional openings extending through the frame, each opening being configured to receive a corresponding printhead module. The assembly can further include one or more additional clamp elements attached to the frame each corresponding to the one or more additional openings and each being adapted to press the corresponding printhead module against an edge of the respective opening when the corresponding printhead module is mounted in the assembly.

In general, in a further aspect, the invention features assemblies for depositing droplets on a substrate during relative motion of the assembly and the substrate along a process direction where the assemblies include a printhead module including a surface that has a array of nozzles through which the printhead module can eject droplets, a frame having an opening extending through the frame and configured to expose the surface of the printhead module including the array of nozzles, a piezoelectric actuator mechanically coupled to the frame and the printhead module, and an electronic controller in electrical communication with the piezoelectric actuator, the electronic controller configured to cause the piezoelectric actuator to vary the position of the printhead module in the opening with respect to an axis of the apparatus.

Embodiments of the assemblies can include one or more of the following features and/or features of other aspects of the invention. The axis can be orthogonal to the process direction. The axis can be parallel to the array of nozzles. The piezoelectric actuator can include a stack of layers of a piezoelectric material.

In general, in another aspect, the invention features an apparatus for depositing droplets on a substrate, including a droplet ejection device including a face having a plurality of nozzles through which droplets can be ejected and a first surface non-parallel to the face, the first surface including a first alignment datum offset from a major portion of the first surface, wherein the first alignment datum aligns the nozzles relative to a first axis of the apparatus when contacting a corresponding alignment datum of the apparatus.

Embodiments of the apparatus can include one or more of the following features and/or features of other aspects of the invention. The major portion of the first surface can be substantially planar. The plurality of nozzles can include an array of nozzles extending along the first axis. The apparatus can include a second surface comprising a second alignment datum offset from a major portion of the second surface, wherein the second alignment datum aligns the nozzles relative to a second axis when the printhead module is mounted with the second alignment datum contacting a corresponding alignment datum of the apparatus. The second axis can be orthogonal to the first axis. The first alignment datum can protrude from the first surface of the body. Alternatively, the first alignment datum can be recessed from the first surface of the body. The first alignment datum can include a planar surface. The planar surface can define a plane substantially orthogonal to the first axis. The planar surface can be substantially parallel to the first surface. The planar surface can have an $R_a$ less than an $R_a$ of the first surface of the body. The planar surface can have an $R_a$ of about 10 micrometers or less (e.g., about eight micrometers or less, about five micrometers or less, about four micrometers or less, about three micrometers or less, about two micrometers or less). The first alignment datum can include a post. The droplet ejection device can be a printhead module (e.g., an ink jet printhead module). The printhead module can include a piezoelectric actuator and a pumping chamber in communication with one of the nozzles and the piezoelectric actuator is configured to apply pressure to ink in the pumping chamber. The apparatus can be configured to print images with a maximum resolution of about 300 dpi or more (e.g., 500 dpi or more, 600 dpi or more, 700 dpi or more, 800 dpi or more, 900 dpi or more, 1,000 dpi or more).

In general, in another aspect, the invention features a frame for mounting a droplet ejection device in an apparatus for depositing droplets on a substrate, the frame including an opening extending through the frame for receiving the printhead module, and a first alignment datum offset from an edge of the opening, wherein the first alignment datum aligns the droplet ejection device relative to a first axis of the apparatus when contacting a corresponding alignment datum of the droplet ejection device.

Embodiments of the frame can include one or more of the following features and/or features of other aspects of the invention. The frame can further include a second alignment datum offset from the edge of the opening, wherein the second alignment datum aligns the droplet ejection device relative to a second axis of the apparatus when contacting a corresponding alignment datum of the droplet ejection device. The first axis can be orthogonal to the second axis. The first alignment datum can protrude from the edge of the opening. The first alignment datum can include a planar surface. The planar surface can define a plane substantially orthogonal to the first axis. The planar surface has an $R_a$ of about 10 micrometers or less (e.g., about eight micrometers or less, about five micrometers or less, about four micrometers or less, about three micrometers or less, about two micrometers or less).

In general, in a further aspect, the invention features a frame for mounting a droplet ejection device in an apparatus for depositing droplets on a substrate, the frame including an opening extending through the frame for receiving the droplet ejection device, and a spring element adapted to spring load the droplet ejection device against a first portion of an edge of the opening when the droplet ejection device is mounted in the frame.

Embodiments of the frame can include one or more of the following features and/or features of other aspects of the invention. The spring element can be adapted to spring load the droplet ejection device in a direction orthogonal to a direction in which the droplet ejection device ejects droplets. The first portion of the opening edge can include an alignment datum. The alignment datum can align nozzles in the droplet ejection device relative to a first axis of the apparatus when contacting a corresponding alignment datum of the droplet ejection device. The alignment datum can be offset from the first portion of the opening edge. A second portion of the opening edge different from the first portion can include the spring element. The second portion of the opening edge can be opposite the first portion. The spring element can be attached to a surface of the frame.

In general, in another aspect, the invention features an apparatus for depositing droplets on a substrate, including a droplet ejection device, a frame having an opening extending through the frame for receiving the droplet ejection device, an actuator coupling the droplet ejection device to the frame, and an electronic controller coupled to the actuator, wherein during operation the electronic controller causes the actuator to vary the position of the droplet ejection device in the opening with respect to an axis of the apparatus.

Embodiments of the apparatus can include one or more of the following features, and/or features of other aspects of the invention. The axis can be orthogonal to a direction in which the droplet ejection device ejects droplets.

In general, in a further aspect, the invention features an apparatus, including first and second droplet ejection devices, each comprising an alignment datum offset from a surface of the respective droplet ejection device, wherein the alignment datum of the first droplet ejection device contacts the alignment datum of the second droplet ejection device.

Embodiments of the apparatus can include one or more of the following features, and/or features of other aspects of other aspects of the invention. The droplets form an image on the substrate having a resolution and the dithering can have an amplitude less than a pixel size of the resolution. Ejecting can be completed in a single pass of the substrate relative to the droplet ejection device. The droplet ejection device can be coupled to a frame by an actuator which moves the droplet ejection device relative to the frame to cause the dithering.

In general, in a further aspect, the invention features a method, including ejecting droplets from a droplet ejection device onto a substrate while moving the substrate relative to the droplet ejection device in a first direction, and dithering the position of the droplet ejection device in a direction orthogonal to the first direction. Embodiments of the method can include features of other aspects of the invention.

Embodiments of the invention may provide one or more of the following advantages.

In some embodiments, printhead modules can be mounted in a printing device with little or no adjustment required to accurately align the printhead modules. This can reduce or remove the need for iterative alignment. It can also simplify printhead module alignment, thereby reducing the need for having a skilled technician setup the printing device or realign the printhead modules during device maintenance. Subsequently, embodiments of the invention can reduce down-time in a printing device when servicing or replacing printhead modules. Some embodiments can reduce print errors associated with alignment changes due to thermal expansion of a printhead module or frame.

Embodiments can provide automated and/or on-the-fly adjustment of a printhead module's position along one or more axes in a printing device. This can correct printhead module alignment errors without significant printer down time. Systematic print errors due to printhead module misalignment or due to nozzle defects within a printhead module can be reduced by varying the position of the printhead module during printing.

In some embodiments, printhead modules can be compactly arranged, reducing the size of a printing device. Compact arrangements can reduce thermal variations between different printhead modules, which can in turn reduce differential thermal expansion and related print errors.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
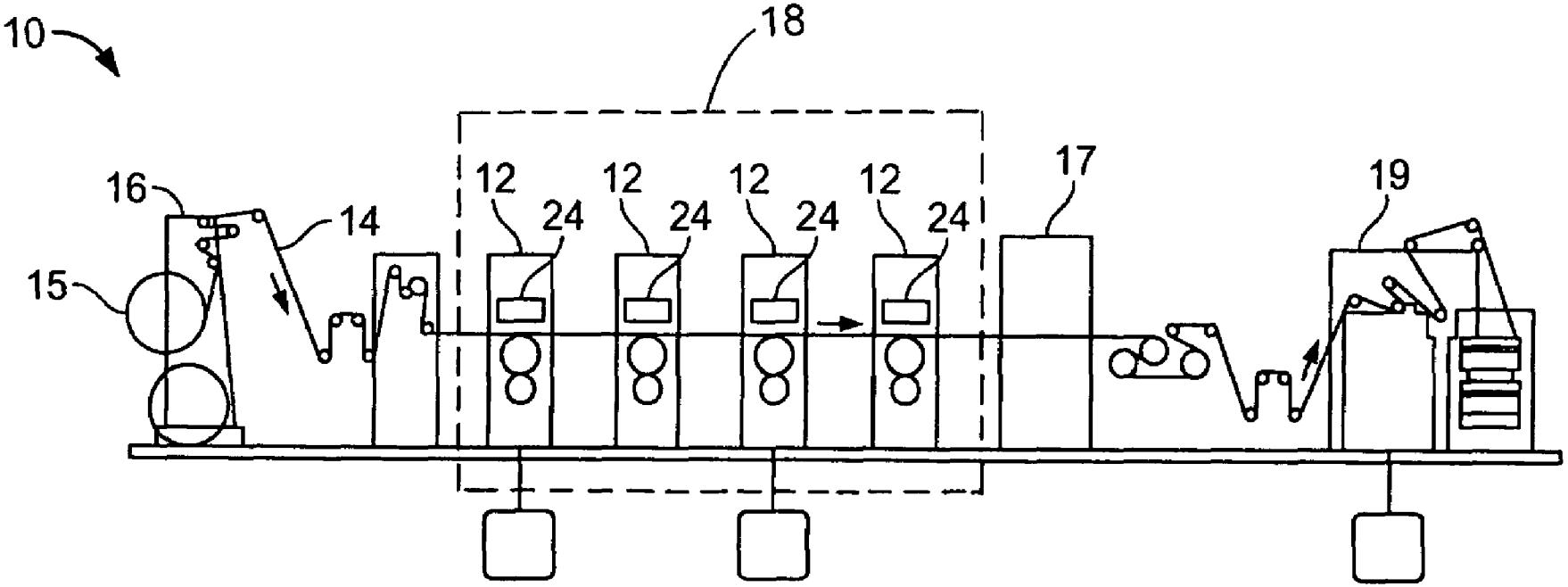
FIG. 1 is a schematic diagram of a continuous web printing press.

Referring to FIG. 1, a continuous web printing press layout 10 includes a series of stations or printing towers 12 for printing different colors onto a moving web 14. The web 14 is driven from a supply roll 15 on stand 16 onto a paper path that leads sequentially to print stations 12. The four print stations define a print zone 18 in which ink is applied to the substrate. An optional dryer 17 may be placed after the final print station. After printing, the web is slit into sheets that are stacked at station 19. For printing wide-format webs, such as newsprint, the print stations typically accommodates a web width of about 25-30 inches or more. A general layout for offset lithographic printing that can be adapted for ink-jet printing is further described in U.S. Pat. No. 5,365,843, the entire contents of which is hereby incorporated by reference.

Figure 2:
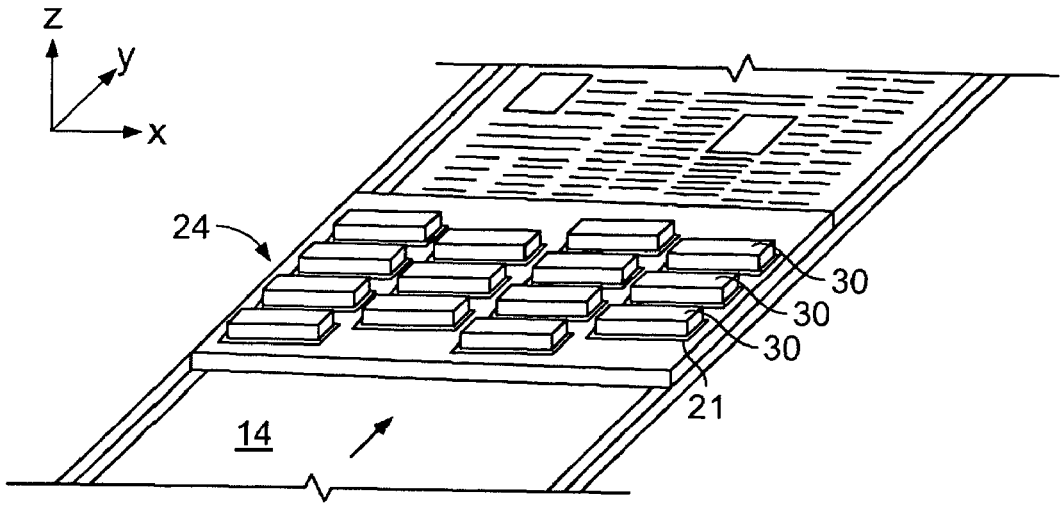
FIG. 2 is a perspective view of a print bar positioned relative to a web in a continuous web printing press.

Referring also to FIG. 2, each print station includes a print bar 24. The print bar 24 is a mounting structure for printhead modules 30 which are arranged in an array and from which ink is ejected to render a desired image on the web 14. The printhead modules 30 are mounted in print bar receptacles 21 such that the faces (not shown in FIG. 2) of the printhead modules from which ink is ejected are exposed from the lower surface of the print bar 24. The printhead modules 30 can be arranged in an array to offset nozzle openings, thereby increasing print resolution or printing speed. In a printing condition, the print bar 24 is arranged above the web path to provide proper alignment and a uniform stand-off distance between the printhead modules 30 and the web 14.

The printhead modules 30 can be of various types, including piezoelectric drop on demand ink-jet printhead modules with arrays of small, finely spaced nozzle openings. Examples of piezoelectric ink-jet printhead modules are described in Hoisington U.S. Pat. No. 5,265,315; Fishbeck et al. U.S. Pat. No. 4,825,227; Hine U.S. Pat. No. 4,937,598; Bibl et al. U.S. patent application Ser. No. 10/189,947, entitled "PRINTHEAD," filed Jul. 3, 2002, and Chen et al. U.S. Provisional Patent Application 60/510,459, entitled "PRINTHEAD MODULE WITH THIN MEMBRANE," filed Oct. 10, 2003, the entire contents all of which are hereby incorporated by reference. Other types of printhead modules can be used, such as, for example, thermal ink-jet printhead modules in which heating of ink is used to effect ejection. Continuous ink-jet heads, that rely on deflection of a continuous stream of ink drops can also be used. In a typical arrangement, the stand off distance between the web path and the print bar is between about 0.5 and one millimeter.

In order to minimize drop placement errors, the printhead modules are accurately aligned relative to each other and relative to the web. In addition to having appropriate angular orientation, a properly aligned printhead module 30 has nozzles appropriately located with respect to three translational degrees of freedom relative to the web. These are represented by x-, y-, and z-positions in the Cartesian co-ordinate system shown in FIG. 2. The web advances in the y-direction (the process direction) and the stand off distance corresponds to the nozzles' location along the z-axis.

Ideally, each nozzle is located at a nominal location from which a defect-free printhead module produces images with no drop placement errors. Practically, however, printhead modules can be aligned with its nozzles within some range of their nominal locations and still provide adequate drop-placement accuracy. Exact tolerances for printhead module alignment depend on the specific application, and can vary for different degrees of freedom. For example, in some embodiments, tolerances for x-axis placement should be smaller than z- and/or y-axis placement. For example, where nozzles from different printhead modules are interlaced to provide increased resolution, constraints on the relative alignment of printhead modules in the x-direction are more stringent that those in the y- and z-directions. In some embodiments, nozzles should be located within about 0.5 pixels (e.g., within about 0.2 pixels) of their nominal locations in the x-direction, while alignment of the nozzles to within about 1-2 pixels of their nominal location in the y-direction can provide sufficient drop placement accuracy. In applications having 600 dpi resolution, for example, one pixel corresponds to about 40 microns. Therefore, where an application demands alignment accuracy to within 0.5 pixels in one direction, a 600 dpi system should have its printhead modules aligned to within about 20 microns of their nominal positions.

Figure 3A:
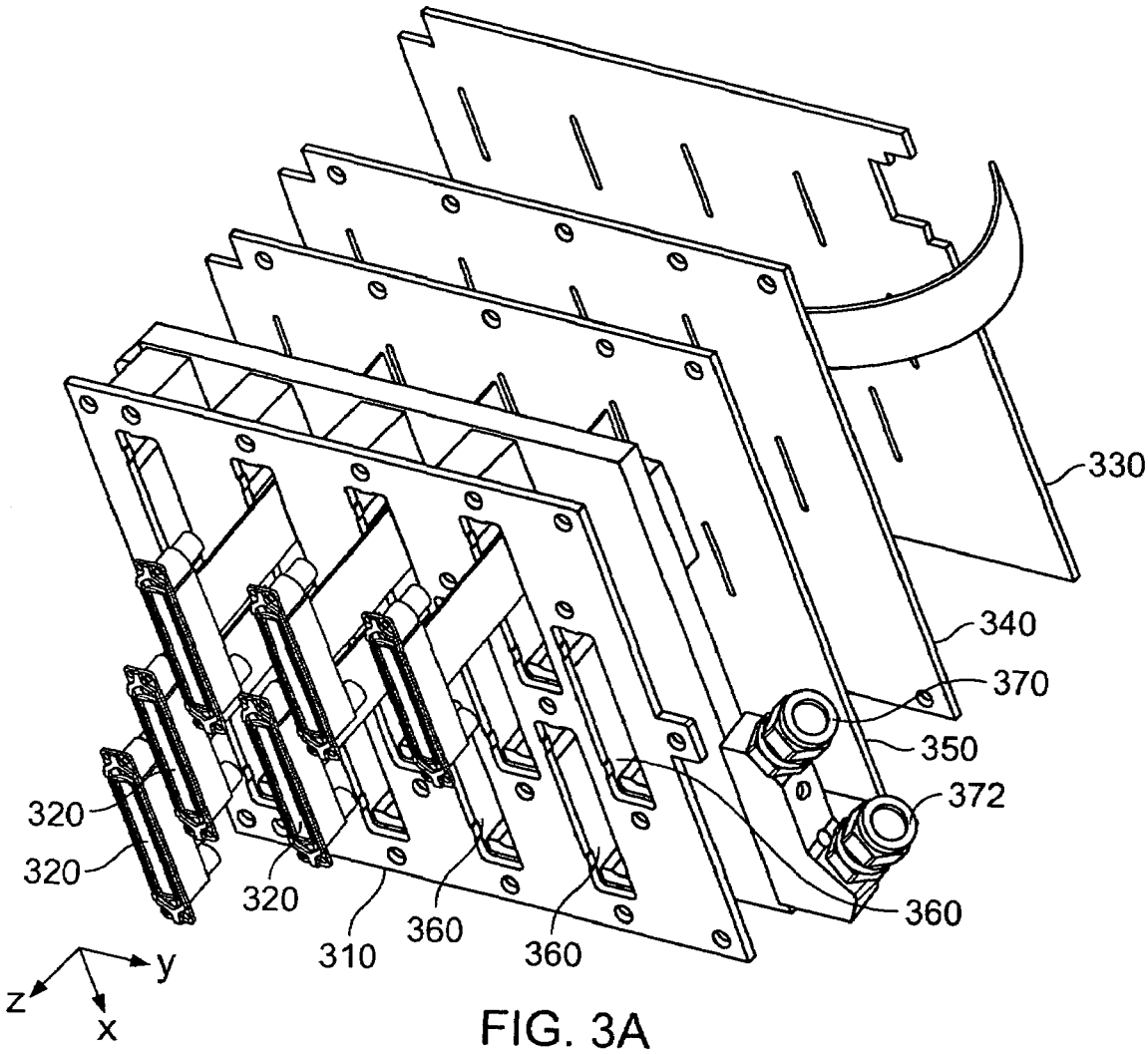
FIGS. 3A and 3B are an exploded and perspective views of printhead modules in a print frame.
Figure 3B:
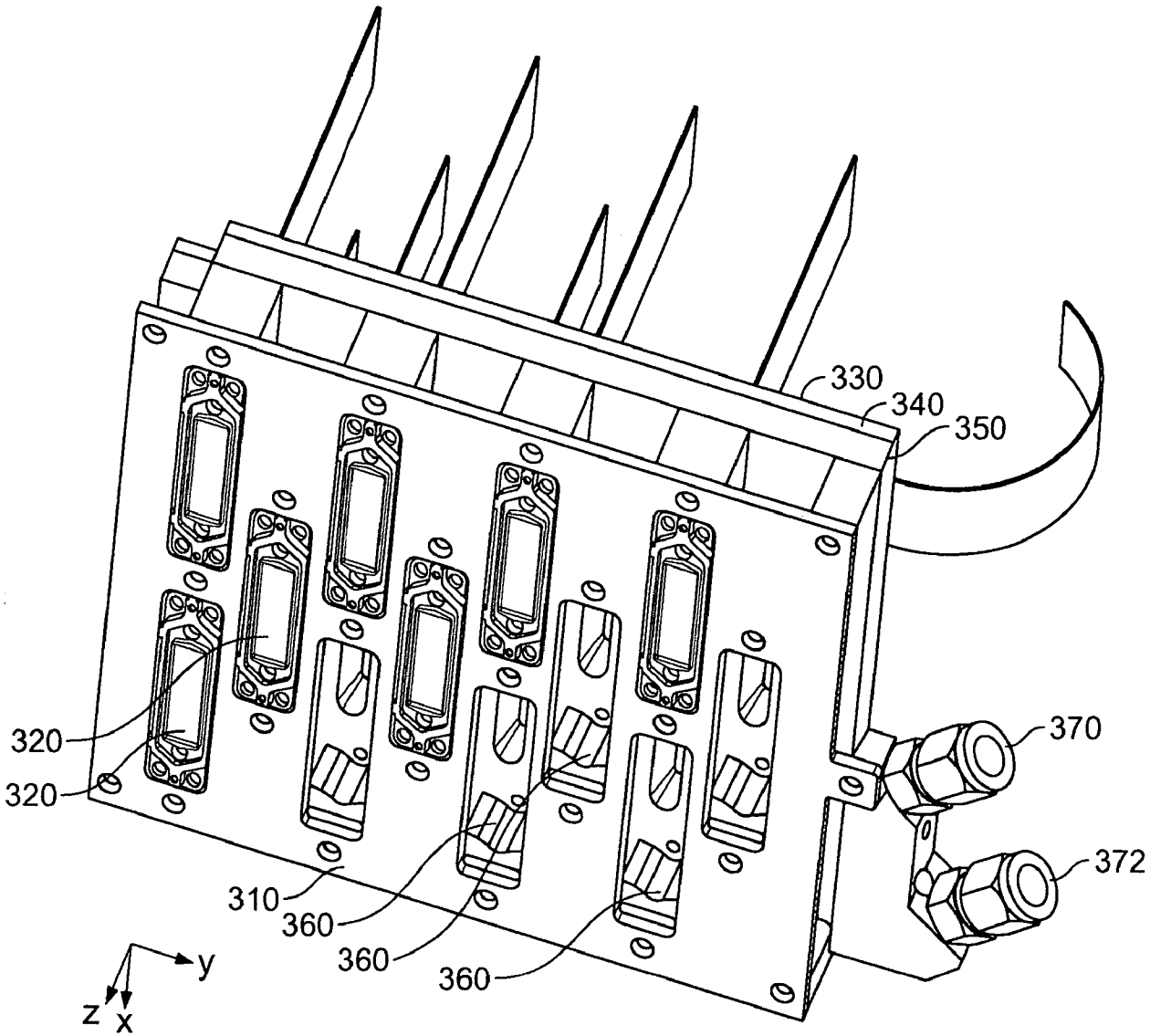

Referring to FIG. 3A and FIG. 3B, in some embodiments, a print bar includes a frame 310 and other support elements 330, 340, and 350. A number of openings 360 (i.e., 12 openings in the present embodiment) are provided in frame 310 in which printhead modules 320 are mounted. Also shown in FIGS. 3A and 3B is inlet port 370 and outlet port 372 which couple to an ink supply (not shown).

Figure 4A:
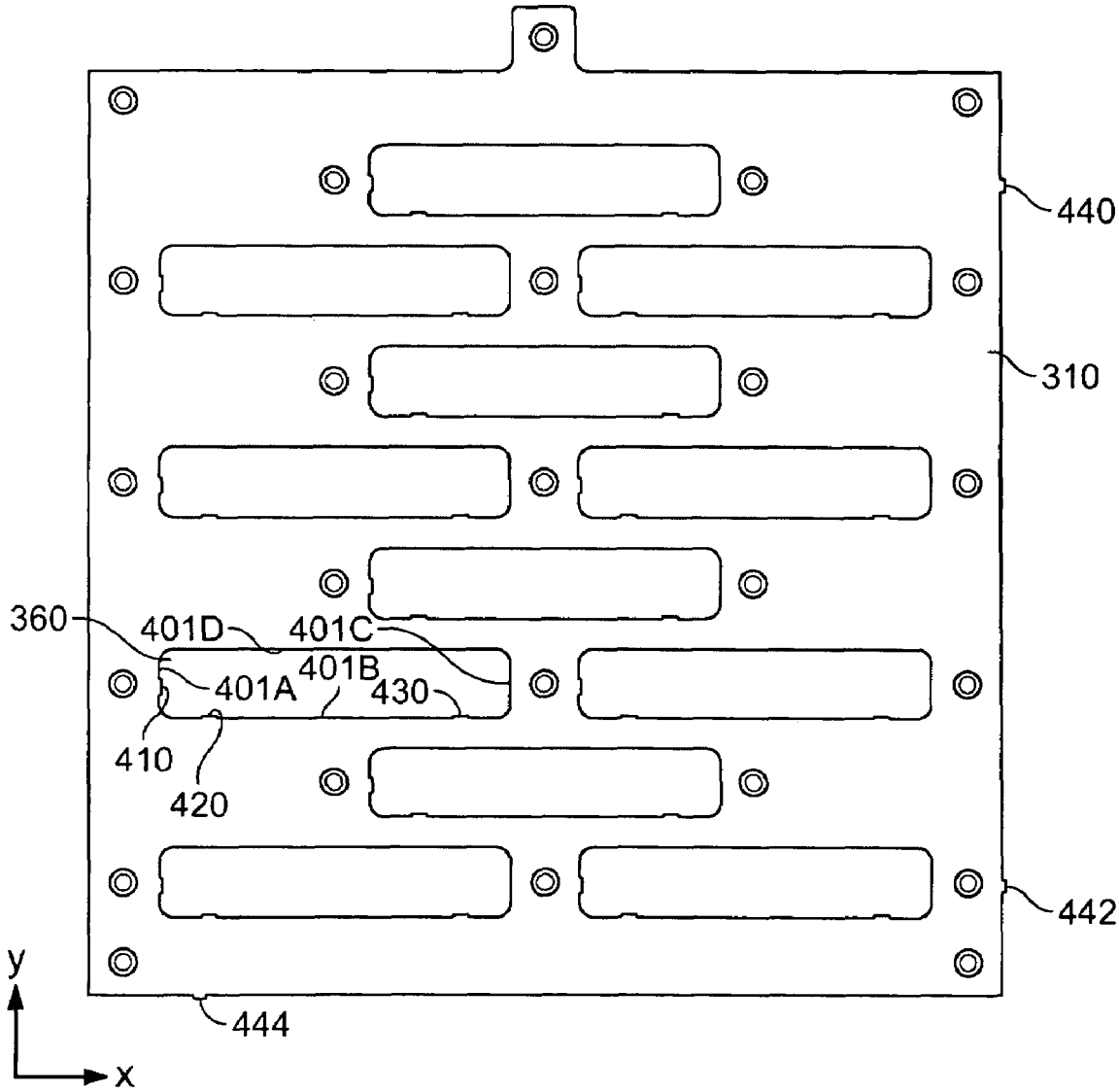
FIG. 4A is a plan view of a frame.

Referring also to FIG. 4A, the edge of each opening 360 includes alignment datums 410, 420, and 430, which form planar protrusions from opening edges 401A and 401B. In addition, frame 310 includes alignment datums 440, 442, and 444 that register frame 310 relative to neighboring frames or to other elements of the print bar.

Figure 4B:
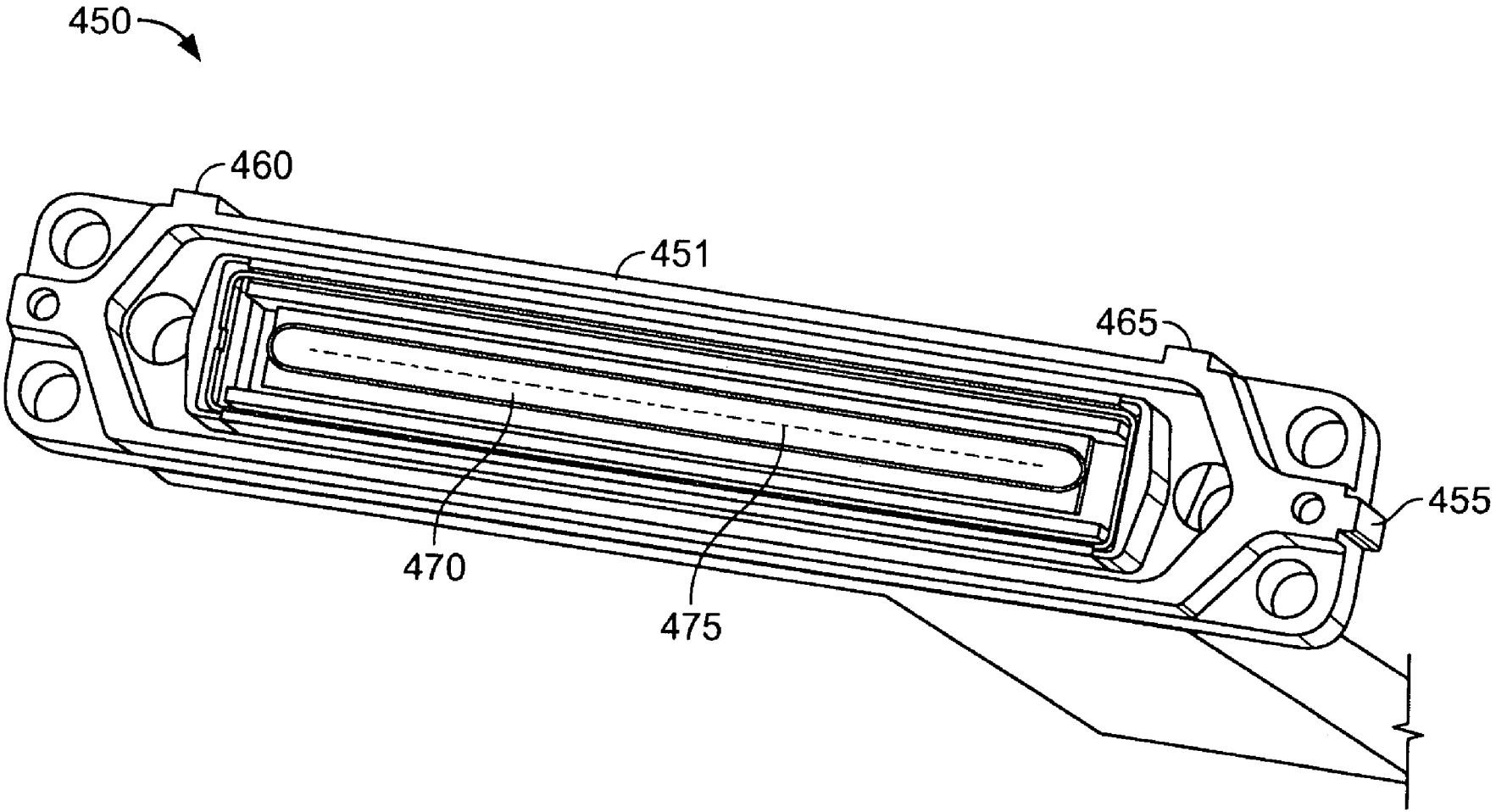
FIG. 4B is a perspective view of a printhead module.
Figure 4C:
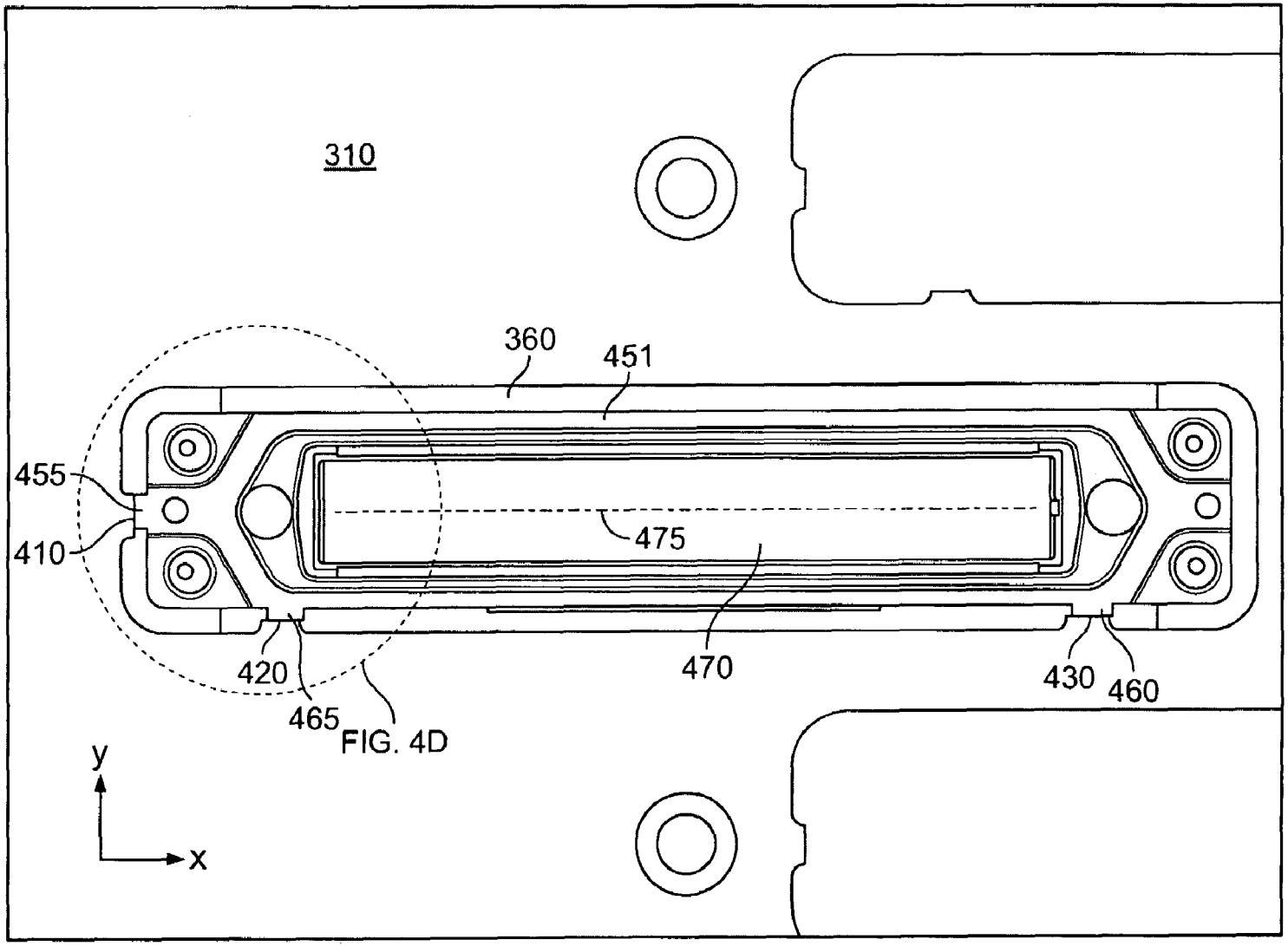
FIGS. 4C and 4D are plan views of the printhead module mounted in the frame.
Figure 4D:
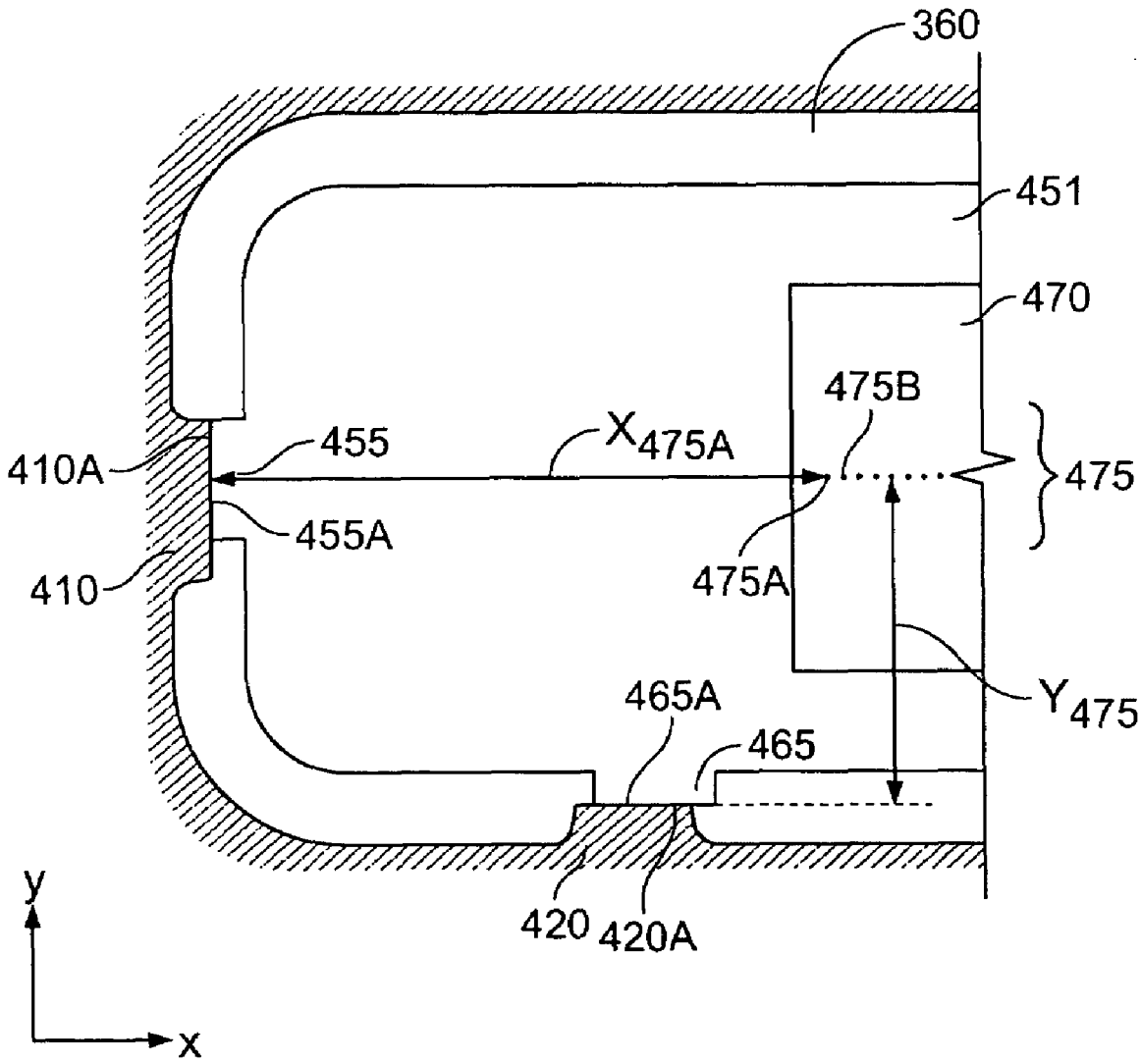

Referring additionally to FIGS. 4B, 4C, and 4D, a printhead module 450 includes a printhead module frame 451 in which is mounted a nozzle plate 470 including a row of nozzles 475. Printhead module frame 451 includes alignment datums 455, 460, and 465, which protrude from edges of printhead module frame 451 and each include a planar surface. When printhead module 450 is properly mounted in opening 360, the planar surface of each of alignment datums 410, 420, and 430 in frame 310 contact corresponding planar surfaces of alignment datums 455, 465, and 460 on the printhead module. Alignment datums 410 and 455 register printhead module 450 in the x-direction and alignment datums 420, 430, 460 and 465 register printhead module 450 in the y-direction. Accordingly, once printhead module 450 is mounted in frame 310 with corresponding alignment datum surfaces in contact with one another, the printhead module is aligned relative to the frame in the x-direction and y-direction. Assuming the frame is properly installed on the print bar, the printhead modules are ready for jetting without additional adjustment.

The alignment datums provide accurate registration of the printhead module to the frame because distances between the planar surfaces of the printhead module alignment datums and the orifices are sufficiently close to a predetermined distance to accurately offset the orifices from the alignment datums of the frame. For example, referring specifically to FIG. 4D, an orifice 475A is a predetermined distance $X_{475A}$ from planar surface 455A of alignment datum 455. Similarly, orifices 475 are a predetermined distance $Y_{475}$ from a plane defined by surface 465A of alignment datum 465. Accordingly, when printhead module 470 is mounted in the frame, orifice 475A is offset a distance $X_{475A}$ from surface 410A of alignment datum 410 in the x-direction and a distance $Y_{475}$ from surface 420A from alignment datum 420 in the y-direction. When the locations of the frame alignment datums are made to similar accuracy, they allow accurate alignment of printhead modules relative to one another in the frame. Similarly, accurate placement of the frame within the printing device aligns all the printhead modules in the frame relative to the substrate.

The planar surfaces of the alignment datums (also referred to as "precision surfaces") should be sufficiently smooth to maintain accurate registration of the printhead module to the frame along an axis regardless of which portion of the planar surfaces of the printhead module alignment datums is in contact with the planar surfaces of corresponding frame alignment datums. In other words, the planar surfaces should be sufficiently smooth so that small shifts of the printhead module position in one direction, due to, e.g., thermal expansion of the printhead module and/or frame, do not appreciably change the orientation of the nozzles or the location of the nozzles with respect to an orthogonal direction.

Typically, the printhead module frame is manufactured so that the planar surface portions of the alignment datums are smoother than adjacent portions of surfaces of the printhead module frame. This can reduce manufacturing time and complexity because, for a particular surface of the printhead module frame, only the alignment datum surfaces, which form only a portion of a printhead module surface, need to be manufactured to high accuracy. For example, for a printhead module having a surface extending for several centimeters or tens of centimeters in one direction, only a small fraction (e.g., a few millimeters) of that surface needs to be precisely manufactured to provide the alignment datum.

In some embodiments, the planar surfaces are prepared to have an arithmetical mean roughness ($R_a$) of about 20 microns or less (e.g., about 15 microns or less, about 10 microns or less, about 5 microns or less). The $R_a$ of a surface can be measured using a profilometer, such as an optical profilometer (e.g., Wyko NT Series profilometer, commercially available from Veeco Metrology Group, Tucson, Ariz.) or a stylus profilometer (e.g., Dektak 6M profilometer, commercially available from Veeco Metrology Group, Santa Barbara, Calif.), for example.

Alignment datums can be made by placing a printhead module frame blank (e.g., a monolithic printhead module frame blank) on a precision machining device (e.g., a dicing saw or a CNC mill) and removing material from the printhead module frame blank to form the alignment datum. Such manufacturing methods are particularly useful where at least one axis of the printhead module cannot easily be cost-effectively controlled using conventional manufacturing processes. Alternatively, or additionally, an attachment including a precision surface can be bonded onto the printhead module frame.

The frame can also be manufactured using a precision manufacturing process, such as wire electrical discharge machining (EDM), jig grinding, laser cutting, computer numerical control (CNC) milling or chemical milling. The frame should be formed from a material that is rigid, sufficiently stable, and has a low thermal coefficient of expansion. For example, the frame can be formed from invar, stainless steel, or alumina.

In the present embodiment, the jetting assemblies are aligned by slipping each into a corresponding opening such that the corresponding alignment datums contact each other. Once a printhead module is inserted into a opening, it is clamped to the frame. In general, a clamp fastens a printhead module to a frame by pressing the printhead module against the frame or against an opposing portion of the clamp. Typically, the clamp holds the printhead module in the frame until it is loosened or released.

Figure 5A:
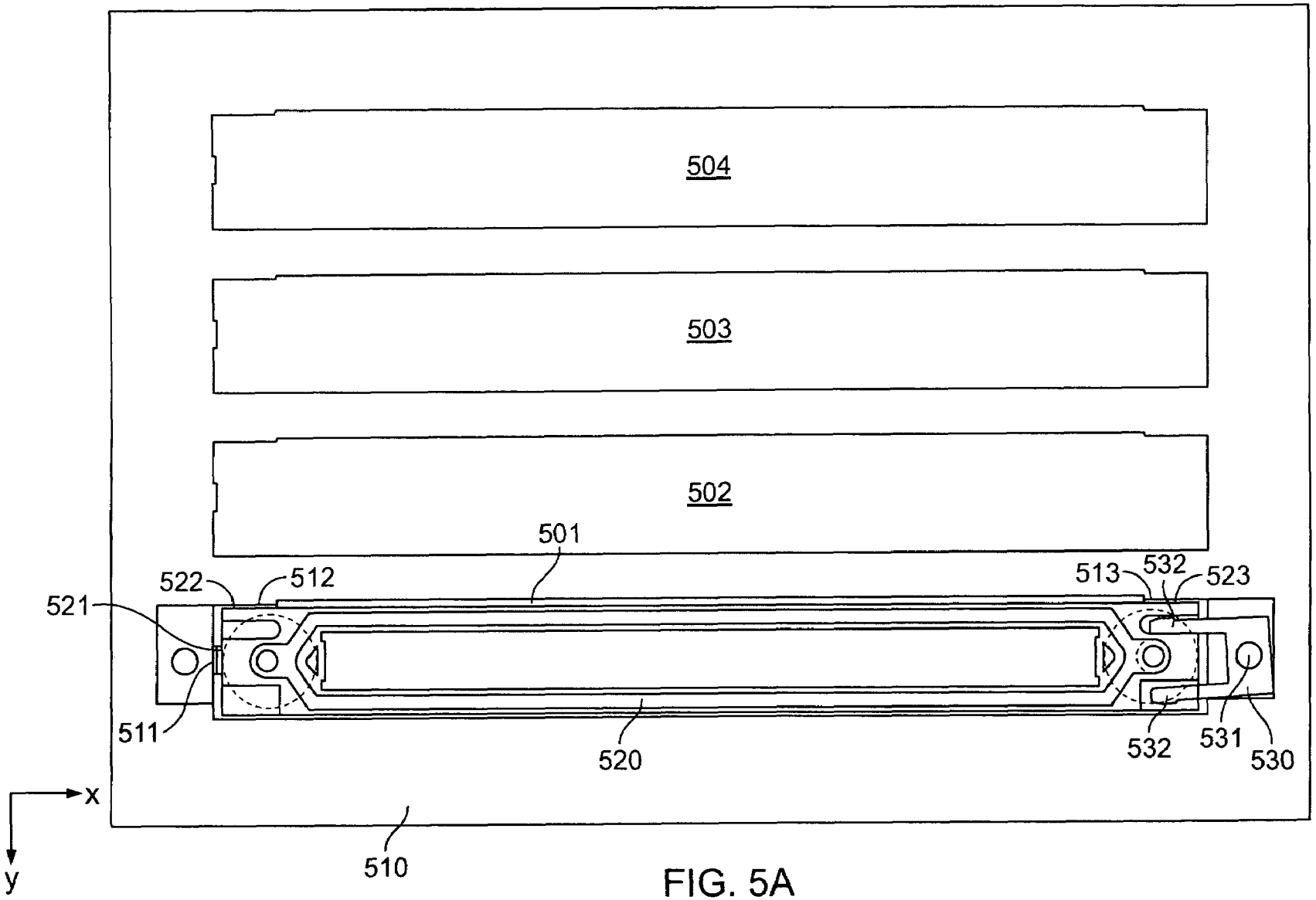
FIG. 5A is a plan view of another embodiment of a printhead module mounted in a frame.

The type of clamp used to secure a printhead module can vary. One type of clamp that can be used is a c-clamp. In certain embodiments, clamps can be secured to the frame using adjustable fasteners (e.g., screws). An example of a clamp is shown in FIG. 5A. Clamp 530 secures a printhead module 520 in a opening 501 of a frame 510. Clamp 530 includes portions 532 which contact printhead module 520 and press the module against other portions of the clamp (not shown in FIG. 5A). Clamp 530 is secured to frame 510 by a fastener 531. When secured, alignment datums 521, 522, and 523 on printhead module 520 contact alignment datums 511, 512, and 513 on frame 510, respectively, registering the printhead module with respect to the frame. Frame 510 also includes openings 502, 503, and 504, which are shown in FIG. 5A.

Figure 5B:
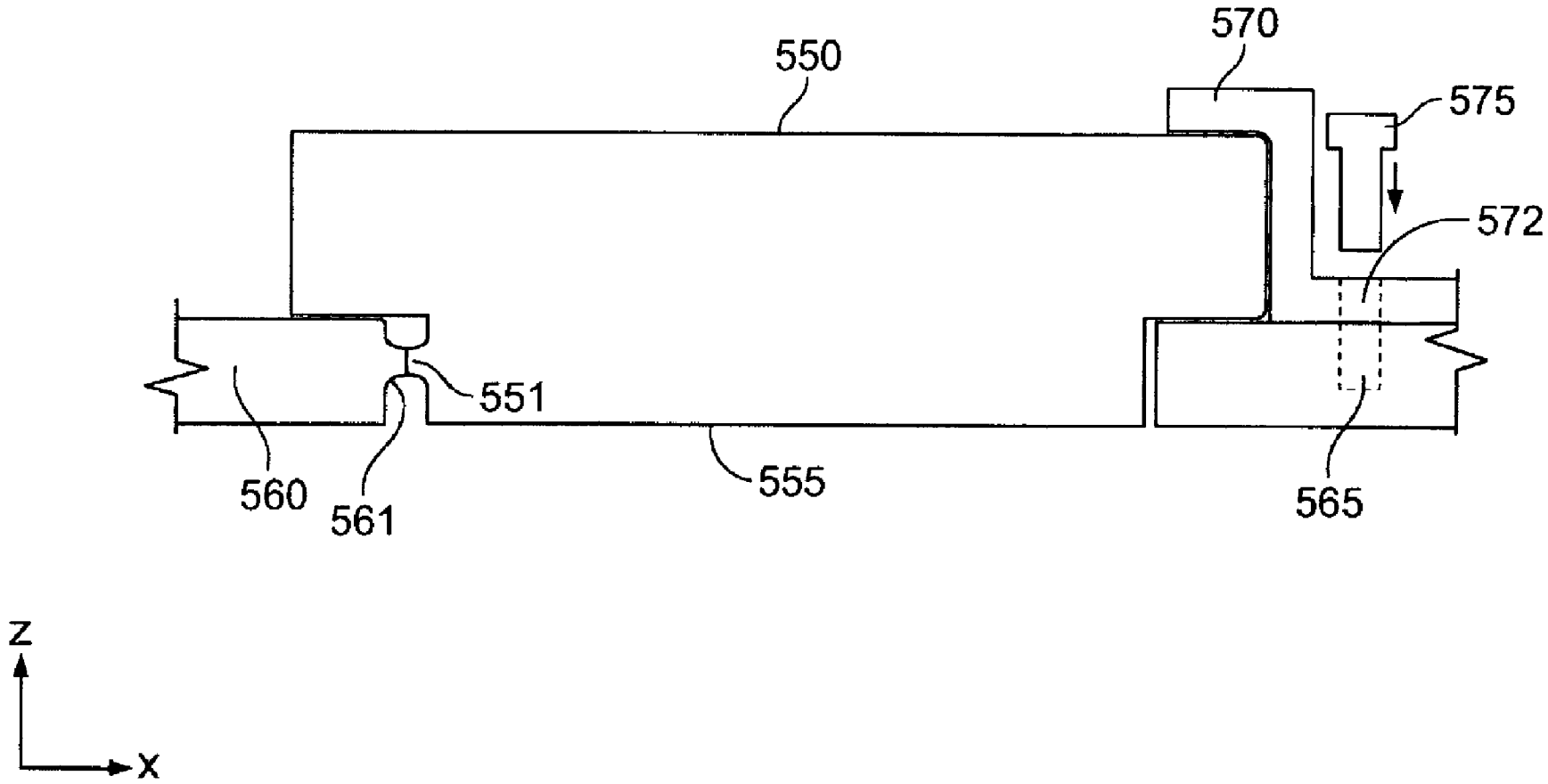
FIG. 5B is a side view of a further embodiment of a printhead module mounted in a frame.

In some embodiments, printhead modules can be clamped to the frame using one or more screws. The torque associated with screw tightening can be decoupled from the printhead module by providing an appropriate clamping element. An example of such a clamping element is a bracket as shown in FIG. 5B. Printhead module 550 clamped to a frame 560 using a clamping bracket 570. Printhead module 550 includes alignment datum 551 that contacts corresponding alignment datum 561 on an edge of a opening in frame 560. Clamping bracket 570 is secured to frame 560 using a screw 575 which inserts through a hole 572 in bracket 570 into a threaded hole 565 in frame 560. Torque applied to screw 575 during clamping is decoupled from printhead module 550 by bracket 570, and does not substantially affect alignment of the printhead module.

In some embodiments, different portions of a printhead module can be clamped with varying force. For example, were thermal stresses are significant, a point near an alignment datum can be clamped with higher force than other points. Such an arrangement can cause any induced slipped, due to thermal expansion, for example, to occur in a predictable/controllable manner, and in a manner that does not cause corresponding alignment datums to become disconnected.

Figure 6A:
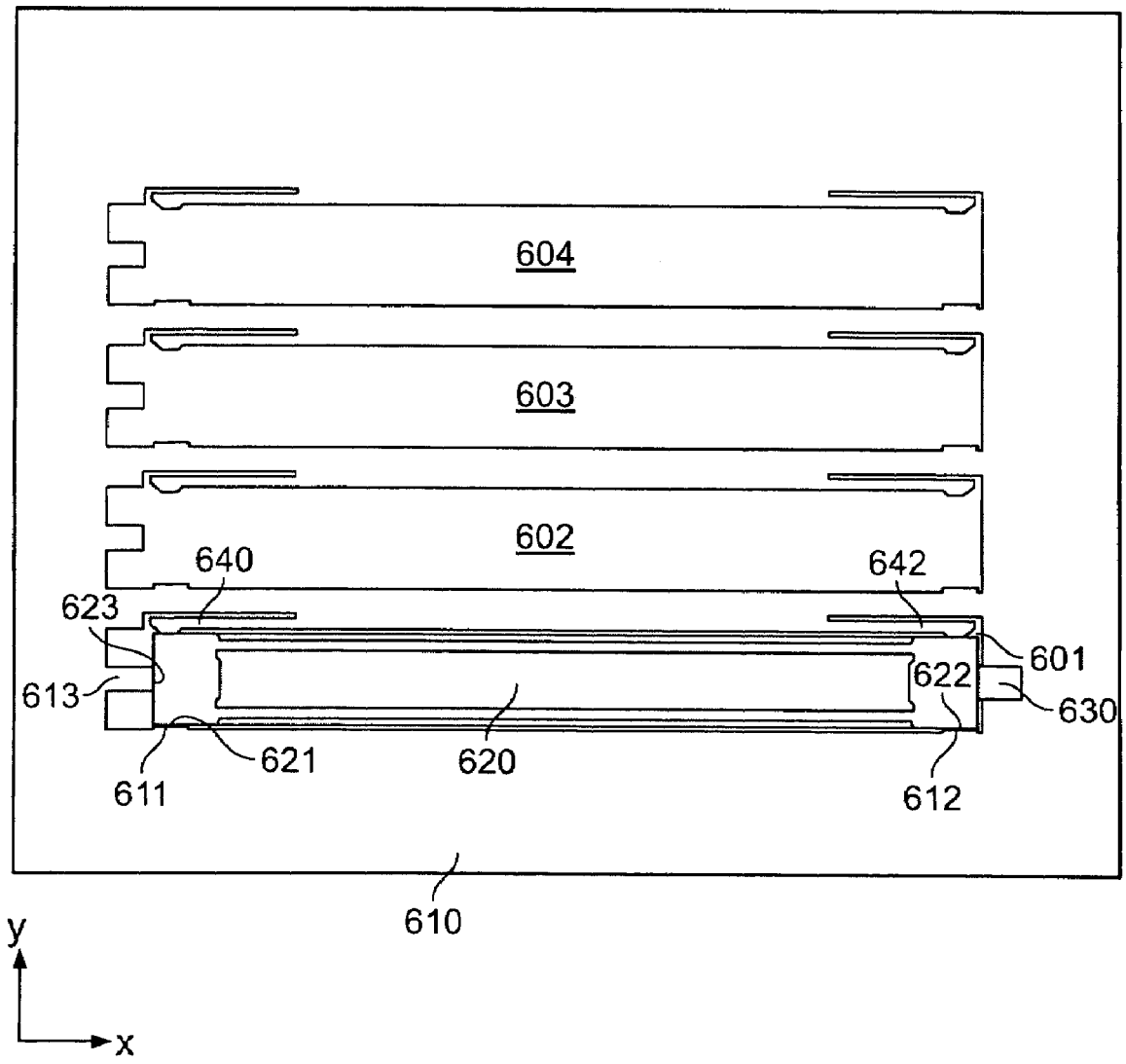
FIG. 6A is a plan view of another embodiment of a printhead module mounted in a frame.

Alternatively, or additionally, to fastening each printhead module to the frame, each printhead module can be loaded against the frame using, e.g., one or more spring elements. A spring element refers to an element that spring loads the printhead module against the frame. Examples of spring elements include coiled springs and flexures. Referring to FIG. 6A, an example of a flexure is shown. A frame 610 includes four openings, 601, 602, 603, and 604, each having two flexures (e.g., flexures 640 and 642 in opening 601). In this example, the flexures are cantilevers that spring load the printhead module (e.g., printhead module 620) in the y-direction. Flexures 640 and 642 load alignment datums 621 and 622 on printhead module 620 against frame datums 611 and 612, respectively. Printhead module 620 also includes an alignment datum 623 which contacts frame alignment datum 613, registering the printhead module in the x-direction. A clamp 630 secures printhead module 620 to frame 610.

Figure 6B:
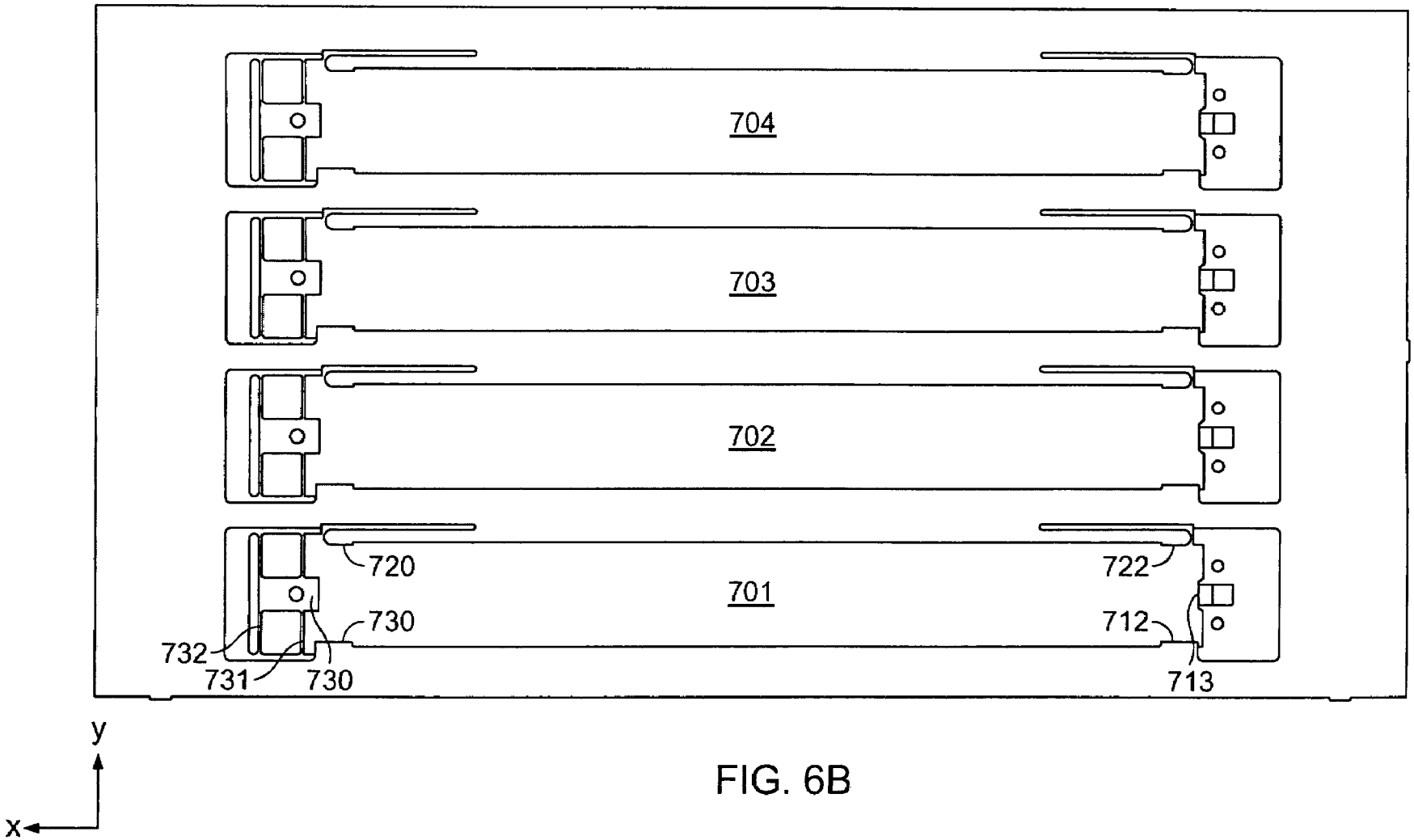
FIG. 6B is a plan view of another embodiment of a frame.

Referring to FIG. 6B, in another embodiment, a frame 710 includes openings 701, 702, 703, and 704 that have spring elements for loading printhead modules in the x- and y-directions. For example, opening 701 includes a flexure 730 that loads a printhead module against alignment datum 713, which registers the printhead module in the x-direction. In addition, frame 710 includes flexures 720 and 722 which load a printhead module against alignment datums 711 and 712 for y-direction registration.

Figure 7:
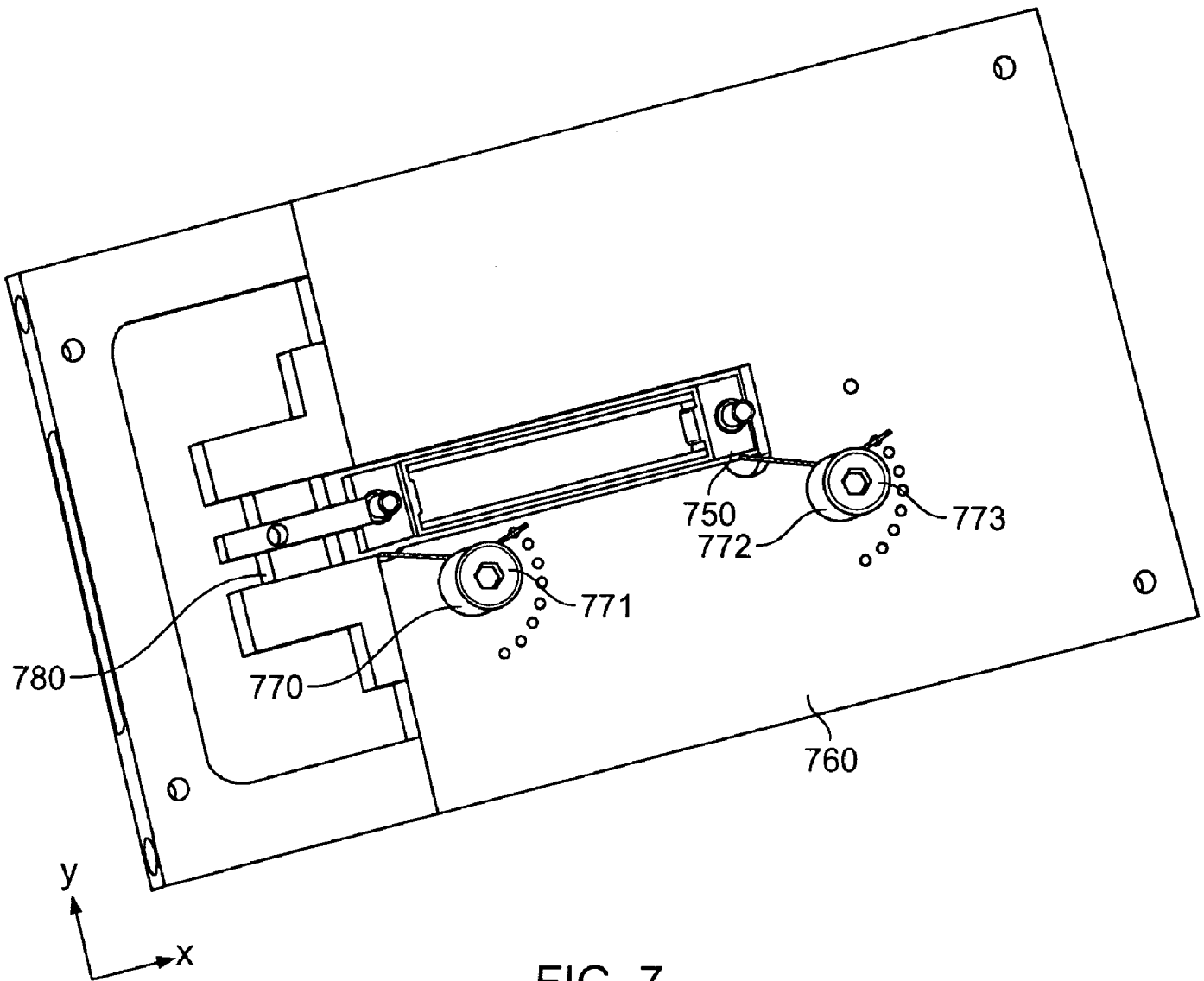
FIG. 7 is a plan view of yet a further embodiment of a printhead module mounted in a frame.

In the foregoing embodiments shown in FIGS. 6A and 6B the spring elements are incorporated in the frame. However, spring elements may also be discrete components that are attached to the frame. For example, referring to FIG. 7, in some embodiments, a printhead module 750 can be spring loaded against the edge of a opening 761 of a frame 760 using discrete coiled springs 770 and 772. Coiled springs 770 and 772 are attached to frame 760 by bolts 771 and 773, respectively, and spring load printhead module 750 in the y-direction. Each coiled spring has an arm (i.e., arms 775 and 776) that couple to frame 760 via holes 777 and 778. The force each coiled spring applies to printhead module 750 can be adjusted by changing the hole to which its arm couples. A flexure 780 spring loads printhead module 750 against frame 760 in the x-direction.

Mounting printhead modules in a frame using spring elements can be advantageous because the spring elements accommodate volume changes in the printhead module relative to the frame's opening, e.g., due to thermal expansion, without substantially changing the amount of force applied to the printhead module. In contrast, where a printhead module is tightly clamped to the frame, an increased clamping force that can accompany an increase in the printhead module's size due to thermal expansion can cause undesirable stress on the printhead module.

In aforementioned embodiments that include alignment datums, the alignment datums are planar surfaces. However, in general, alignment datums can take other forms. In general, the alignment datum can take any form that provides sufficiently accurate registration of the printhead module to the frame in at least one degree of freedom. The alignment datums should also be sufficiently large and robust so as not to be deformed by mechanical mounting.

Figure 8A:
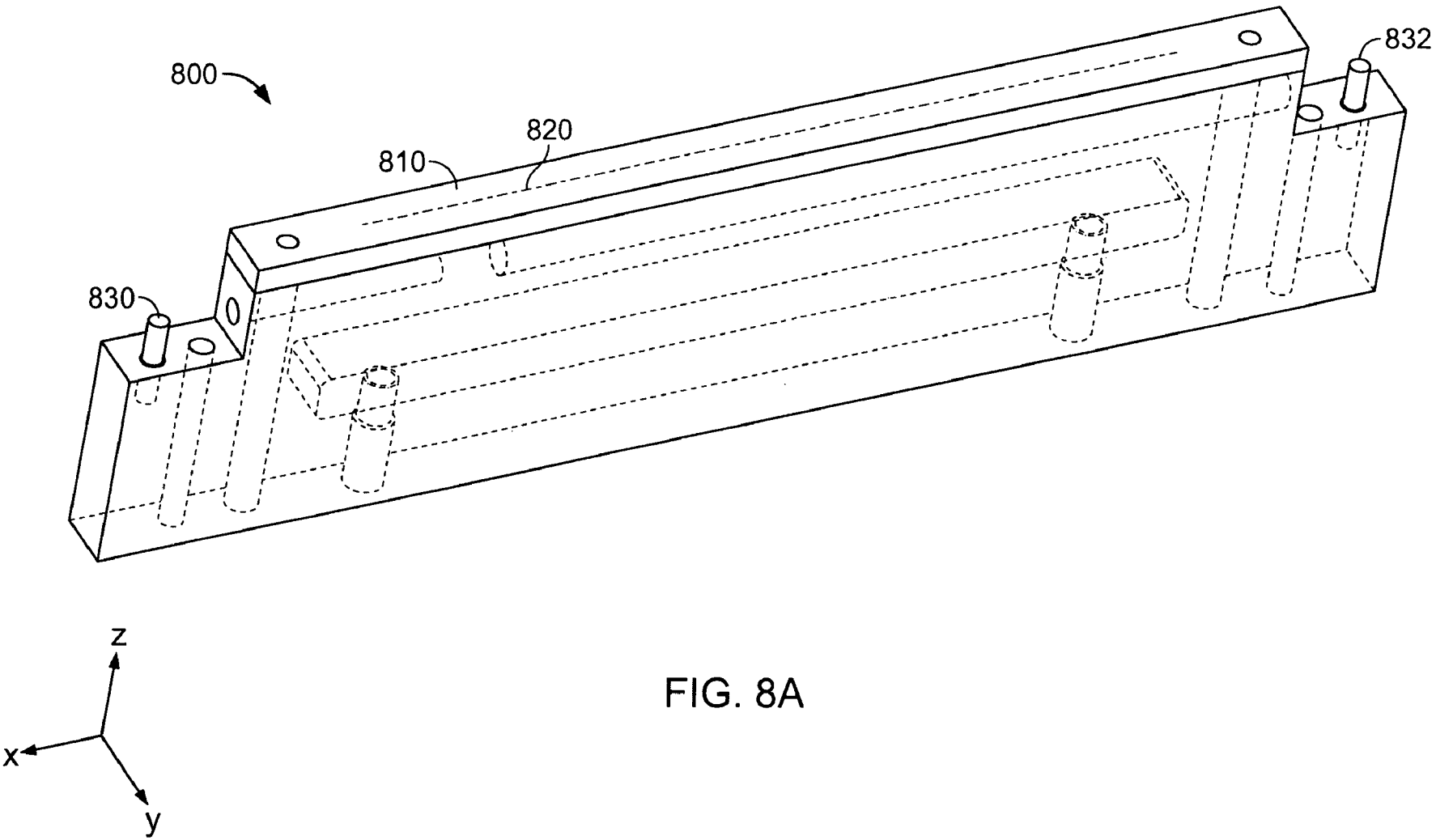
FIG. 8A is a perspective view of another embodiment of a printhead module.

In some embodiments, some alignment datums can be recessed (e.g., in the form of a bored hole) and can mate with corresponding protrusions. For example, referring to FIG. 8A and FIG. 8B, a printhead module 800 can include alignment datums in the form of posts 830 and 832, which insert into corresponding holes 841 and 842 in a frame 840. These alignment datums register printhead module 800 with respect to the x-axis and y-axis. Posts 830 and 832 can be adjusted during assembly of printhead module 800 so that they are correctly oriented with respect to nozzles 820 in nozzle plate 810.

Figure 8B:
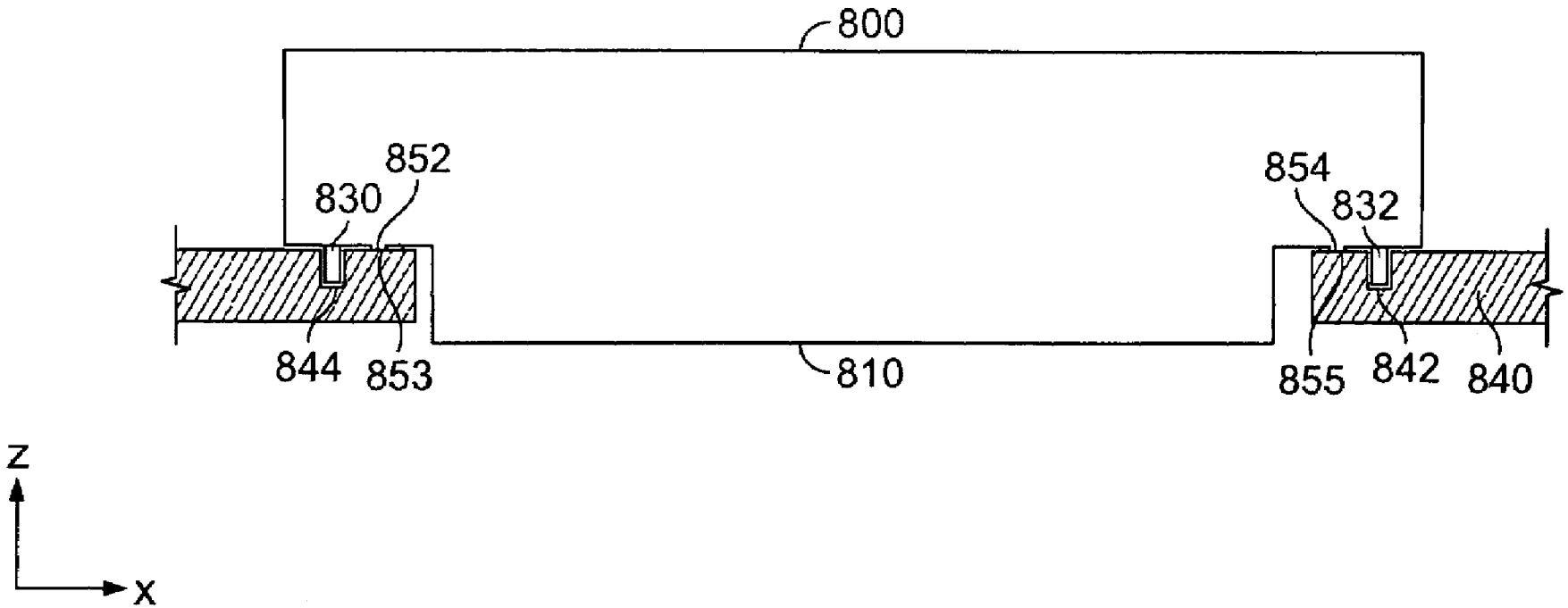
FIG. 8B is a side view of the printhead module shown in FIG. 8A mounted in a frame.

Furthermore, although the foregoing embodiments include alignment datums for registering a printhead module in the x- and y-directions, alignment datums can also be used to register a printhead module in the z-direction. Referring still to FIG. 8B, for example, frame 840 includes alignment datums 853 and 855 which contact corresponding alignment datums 852 and 854 on printhead module 800, respectively. These alignment datums offset the printhead module from the frame in the z-direction, positioning nozzles 820 a desired distance from a substrate (not shown).

Figure 9:
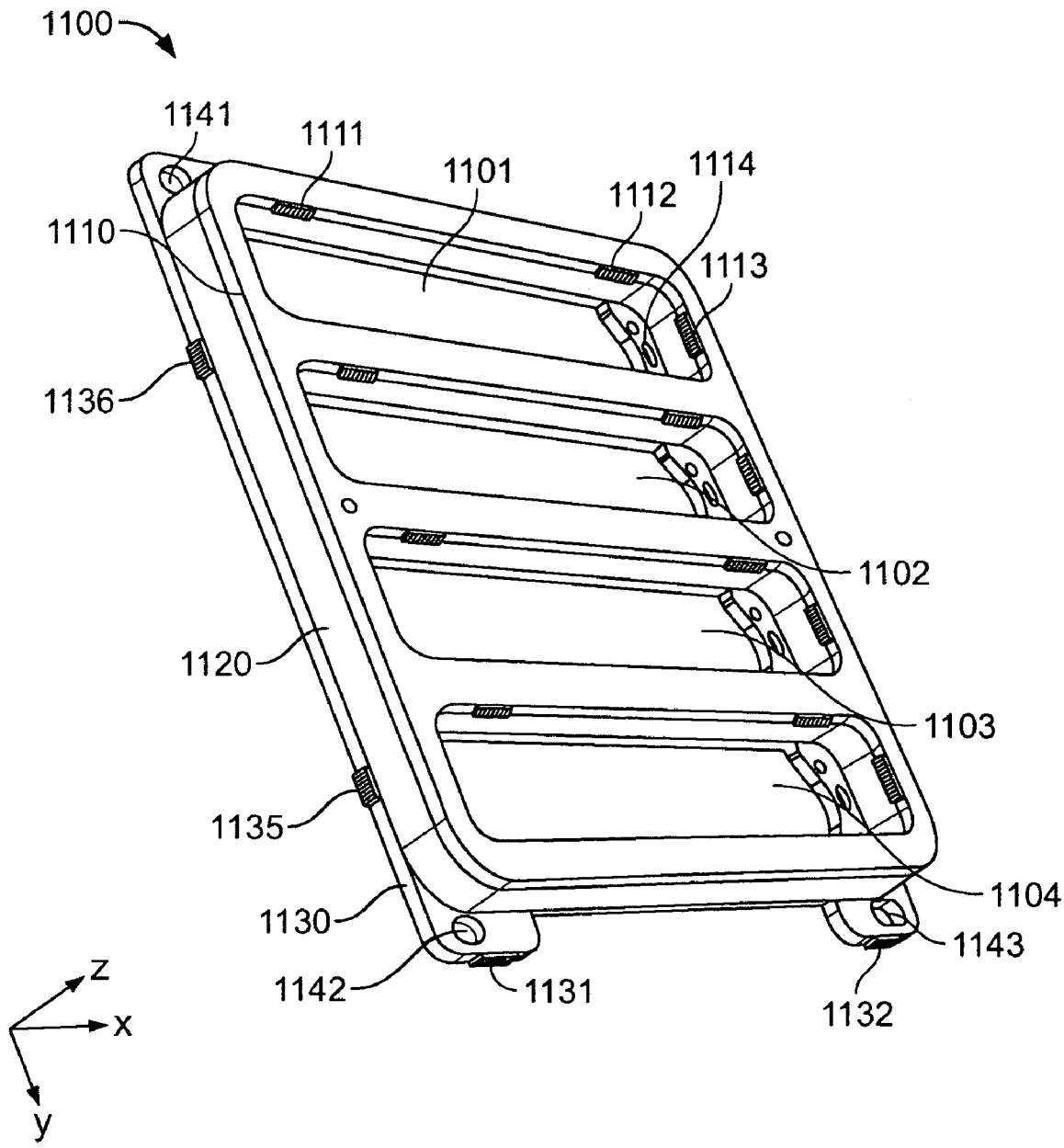
FIG. 9 is a perspective view of a frame for mounting four printhead modules.

Another embodiment of a frame is shown in FIG. 9. In this embodiment, frame 1100 has four openings 1101-1104 for mounting printhead modules. Frame 1100 is a laminate structure and includes registration plates 1110 and 1130, and a spacer 1120. Registration plate 1110 includes alignment datums 1111, 1112, and 1113 for registering a printhead inserted into opening 1101 in the x- and y-directions. In particular, alignment datums 1113 provide registration of a printhead in the x-direction, while datums 1111 and 1112 provide registration of a printhead in the y-direction. Registration plate 1110 includes corresponding alignment datums for registering printheads in the x- and y-directions in openings 1102-1104.

Registration plate 1130 includes alignment datum 1114 for registering a printhead inserted into opening 1101 in the z-direction. Registration plate 1130 includes another alignment datum (not shown in FIG. 9 due to the perspective of the figure) on the opposite side of opening 1101 from alignment datum 1114. Furthermore, registration plate 1130 includes corresponding alignment datums for registering printheads in the z-direction in openings 1102-1104.

Furthermore, frame 1100 includes alignment datums for registration to other frames. Alignment datums 1131 and 1132, on the edge of registration plate 1130, register the frame to another frame in the y-direction, while alignment datums 1135 and 1136 register the frame to another frame in the x-direction. Registration plate 1130 also includes holes 1141-1143 for bolting the frame to a print bar or other structure of the printing system in which the frame is mounted.

Frame 1100 can be relatively thin (i.e., in the z-direction). For example, frame 1100 can have a thickness of about 2 cm or less (e.g., about 1.5 cm or less, about 1 cm or less).

In embodiments, registration plates 1110 and 1130 can be formed from a rigid material, such as materials that include one or more metals (e.g., alloys, such as invar). The material can have similar thermomechanical properties (e.g., coefficient of thermal expansion (CTE)) as the material(s) from which the printheads are formed. For example, the CTE of the material(s) from which the registration plate materials are formed can be within about 20 percent or less (e.g., about 10 percent or less, about 5 percent or less) over a range of temperatures at which the printheads usually operate (e.g., from about 20° C. to about 150° C.).

Registration plates 1110 and 1130 can be formed by sheet metal processing methods, such as stamping, and/or by EDMing. The alignment datums on registration plates 1110 and 1130 can be formed by gouging and/or EDMing, for example.

Spacer 1120 can be formed from a material having similar thermomechanical properties as the material(s) used to form registration plates 1110 and 1130. In some embodiments, spacer 1120 can be formed from a material having a high thermal conductivity, and spacer 1120 can act as a thermal node. Alternatively, or additionally, the material forming spacer 1120 can exhibit relatively low thermal expansion. Furthermore, spacer 1120 can be formed from a material which has a high level of chemical inertness, to reduce any undesirable chemical reactions of the spacer with other materials in the frame and/or with the environment. In some embodiments, spacer 1120 can be formed from a material having a high electrical conductivity. High electrical conductivity can reduce build up of static charge on the frame.

As an example, spacer 1120 can be formed form a liquid crystalline polymer (LCP) (e.g., CoolPoly® E2 commercially available from Cool Polymers Inc., Warwick, R.I.).

In some embodiments, spacer 1120 is injection molded. Alternatively, the spacer can be machined from a blank sheet of material.

Spacer 1120 can include registration features which couple to corresponding features in other layers of frame 1100 (e.g., in the registration plates), aligning the apertures in each layer to provide openings 1101-1104.

Registration plates 1110 and 1130 are secured (e.g., bonded or screwed) to either side of spacer 1120. In some embodiments, an epoxy (e.g., a B-stage epoxy) is used to bond registration plates 1110 and 1130 to spacer 1120.

In some embodiments, additional layers can be included in the laminate structure of frame 1100. As an example, frame 1100 can include a heater layer. The heater layer can be bonded to a surface of registration plate 1110 or registration plate 1130. A heater layer can be formed from a Kapton flex circuit, for example.

Figure 10:
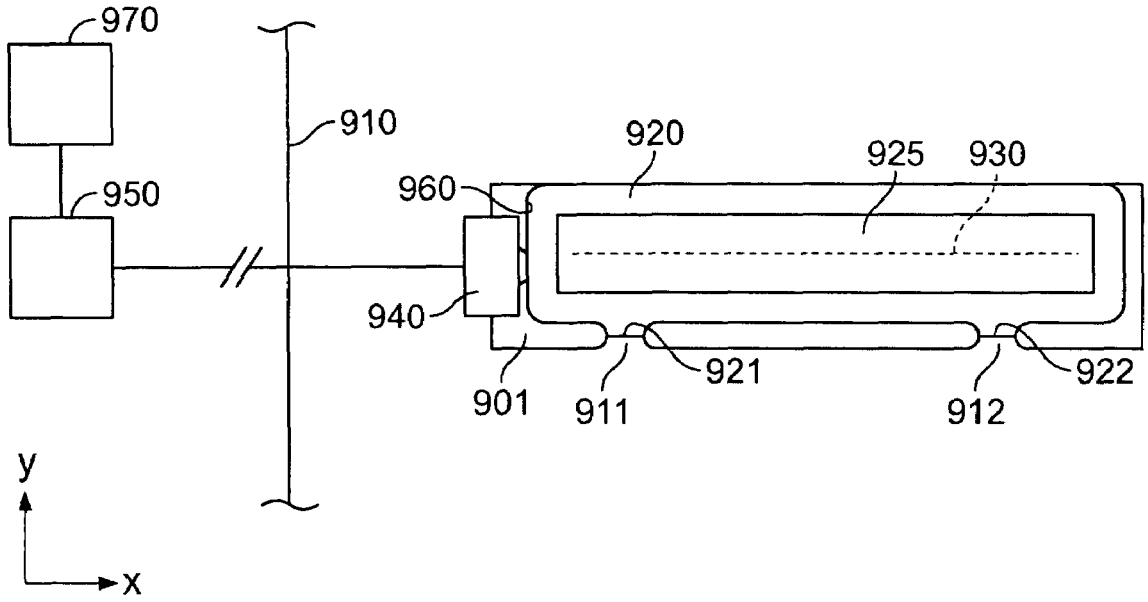
FIG. 10 is a schematic diagram of a printhead module mounted coupled to a frame with an actuator.

Although the foregoing embodiments relate to printhead modules which do not require adjustment along various degrees of freedom due to registration using alignment datums, in other embodiments printhead modules can include one or more actuators that adjust the printhead module position with respect to one or more degrees of freedom. For example, referring to FIG. 10, a frame 910 includes an actuator 940 that is coupled to a surface 960 of a printhead module 920 in a frame opening 901. Printhead module 920 includes an orifice plate 925 having an array of orifices 930. During operation, actuator 940 adjusts the position of printhead module 920 in the x-direction as necessary. Printhead module 920 also includes alignment datums 921 and 922 which contact corresponding frame alignment datums 911 and 912.

Actuator 940 can be an electromechanical actuator, such as a piezo-electric or electro static actuator. Examples of piezo-electric actuators include stacked piezo-electric actuators that include multiple layers of piezo-electric material stacked to increase the actuators dynamic range compared to a single layer of piezo-electric material. Stacked piezo-electric actuators are available commercially (e.g., from companies such as PI (Physik Instrumente) L.P., Auburn, Mass.).

The actuator should have a minimum range of motion on the order of the image pixel spacing. Stacked piezo-electric actuators, for example, can have a dynamic range of about 5 to about 300 microns.

Actuator 940 responds to drive signals from an electronic controller 950. In some embodiments, controller 950 causes actuator 940 to adjust the position of printhead module 920 in the x-direction in response to a signal from a monitoring system 970 (e.g., an optical monitoring system, such as including a CCD camera). Monitoring system 970 monitors images (e.g., test images) printed using printhead module 940 for drop placement errors associated with misalignment of printhead module 940 in the x-direction. Where a drop placement error is detected, electronic controller 950 determines the magnitude and direction of printhead module misalignment that gave rise to the error. Based on this determination, the controller sends a signal to actuator 940. The actuator changes the position of the printhead module in order to reduce or eliminate errors arising from printhead module misalignment.

In some embodiments, actuator 940 can dither printhead module 920 back and forth in the x-direction during printing. This can reduce the effect of drop placement errors due to x-axis alignment on image quality by introducing controlled noise to the image which can mask the errors. Preferably, the printhead module should be dithered a fraction of a pixel (e.g., about ½ a pixel or ¼ of a pixel). Dither frequency can be variable or fixed. Preferably, dither frequency should be lower than jetting frequency (e.g., about 0.1, 0.05, 0.01 times the jetting frequency). However, in embodiments where the dither frequency is comparable or higher than jetting frequency, dither frequency should not be at the jetting frequency or its harmonics.

In embodiments where multiple printhead modules are interlaced, each printhead module can be actuator adjusted. In addition, or alternatively, to adjusting the x-direction alignment of each printhead module to mitigated alignment errors, the actuators can adjust the interlace pattern of the printhead modules. The actuators allow the interlace spacing and/or pattern to be varied rapidly and reliably. Thus, the interlace pattern can be adjusted during printing (e.g., between images) without down time of the printing press.

While in the foregoing embodiments the printhead module alignment datums register the printhead module directly to the frame, in other embodiments alignment datums can be used to register printhead modules directly to other printhead modules. For many applications, particularly those in which printing is completed with a single pass of the substrate relative to the jetting assembly, several printhead modules are positioned along the process direction (i.e., the y-direction) to achieve the requisite spatial density for the desired print quality. To reduce adverse effects of process variation on image quality, printhead modules should preferably placed very close together in the process direction.

Figure 11A:
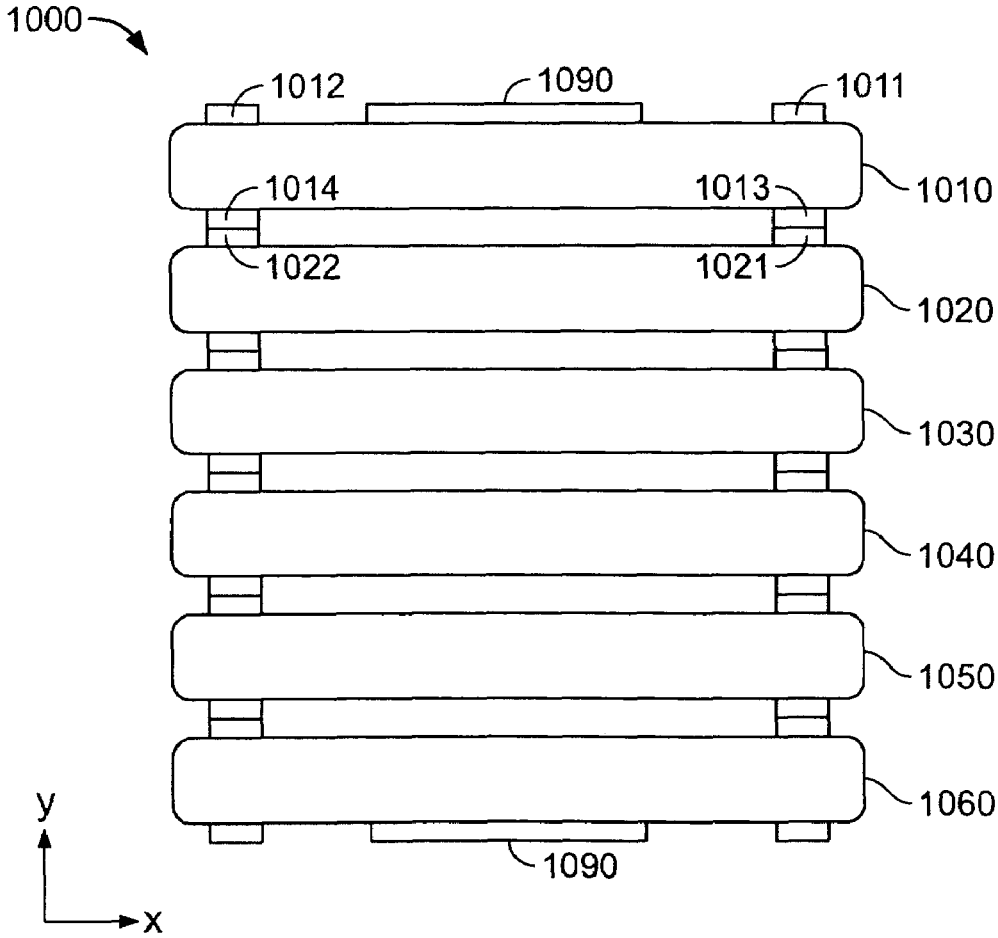
FIG. 11A is a schematic diagram of an assembly including multiple printhead modules.

Referring to FIG. 11A, in some embodiments, close printhead module spacing is achieved by stacking multiple printhead modules together to form a 2-D jetting array 1000. While jetting array 1000 includes six printhead modules (i.e., printhead modules 1010, 1020, 1030, 1040, 1050, and 1060), in general, the number of printhead modules in a jetting array can vary as desired. Adjacent printhead modules are registered in the y-direction via alignment datums. For example, printhead module 1010 has alignment datums 1013 and 1014, which register it to printhead module 1020 via alignment datums 1021 and 1022. In addition, printhead module 1010 includes alignment datums 1011 and 1012, which register the printhead module in the y-direction to a frame (not shown). A clamp 1090 clamps the subassembly together once the printhead modules have been stacked with corresponding datums aligned (e.g., using a c-clamp). The printhead modules in jetting array 1000 can share a common ink supply and temperature control system.

Figure 11B:
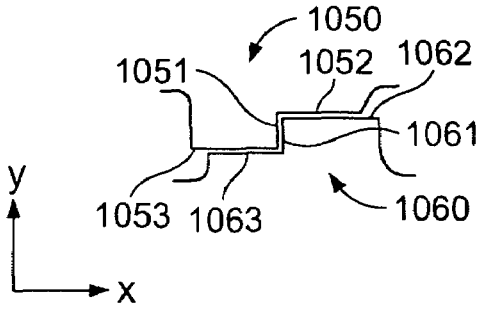
FIGS. 11B and 11C are schematic diagrams of embodiments of alignment datums.

Corresponding nozzles in adjacent printhead modules can be offset along the x-axis to increase the print resolution of the jetting array. For example, referring to FIG. 11D, a jetting array 1200 includes three printhead modules 1210, 1220, and 1230 that are stacked together. Corresponding nozzles in printhead modules 1210 and 1220 are offset by an amount approximately equal to d/n, where d is the spacing between adjacent nozzles (e.g., between nozzles 1211A and 1211B, 1221A and 1221B, and 1231A and 1231B) in a nozzle array, and n is the number of printhead modules in stacked in the jetting array. Similarly corresponding nozzles in printhead modules 1220 and 1230 are also offset by din in the x-direction. Accordingly, the print resolution in the x-direction of the jetting assembly is reduced by a factor of n. As an example, a jetting array having a resolution of about 50 μm can be assembled from six printhead modules each having an individual resolution of about 300 μm.

In some embodiments, the alignment datums on the printhead modules can include features that allow alignment of the printhead modules in the x-direction to provide the desired jet pitch. For example, referring to FIG. 11B, protruding alignment datums 1050 and 1060 can each include multiple precision surfaces which register the printhead modules relative to one another in both the x- and y-directions. In the present embodiment, alignment datum 1050 includes precision surfaces 1051, 1052, and 1053. Similarly, alignment datum 1060 includes precision surfaces 1061, 1062, and 1063. Surfaces 1051 and 1061 register the printhead modules in the x-direction, while surfaces 1052, 1053, 1062, and 1063 register the printhead modules in the y-direction.

Figure 11C:
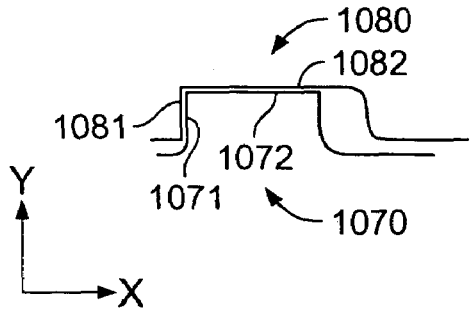
Figure 11D:
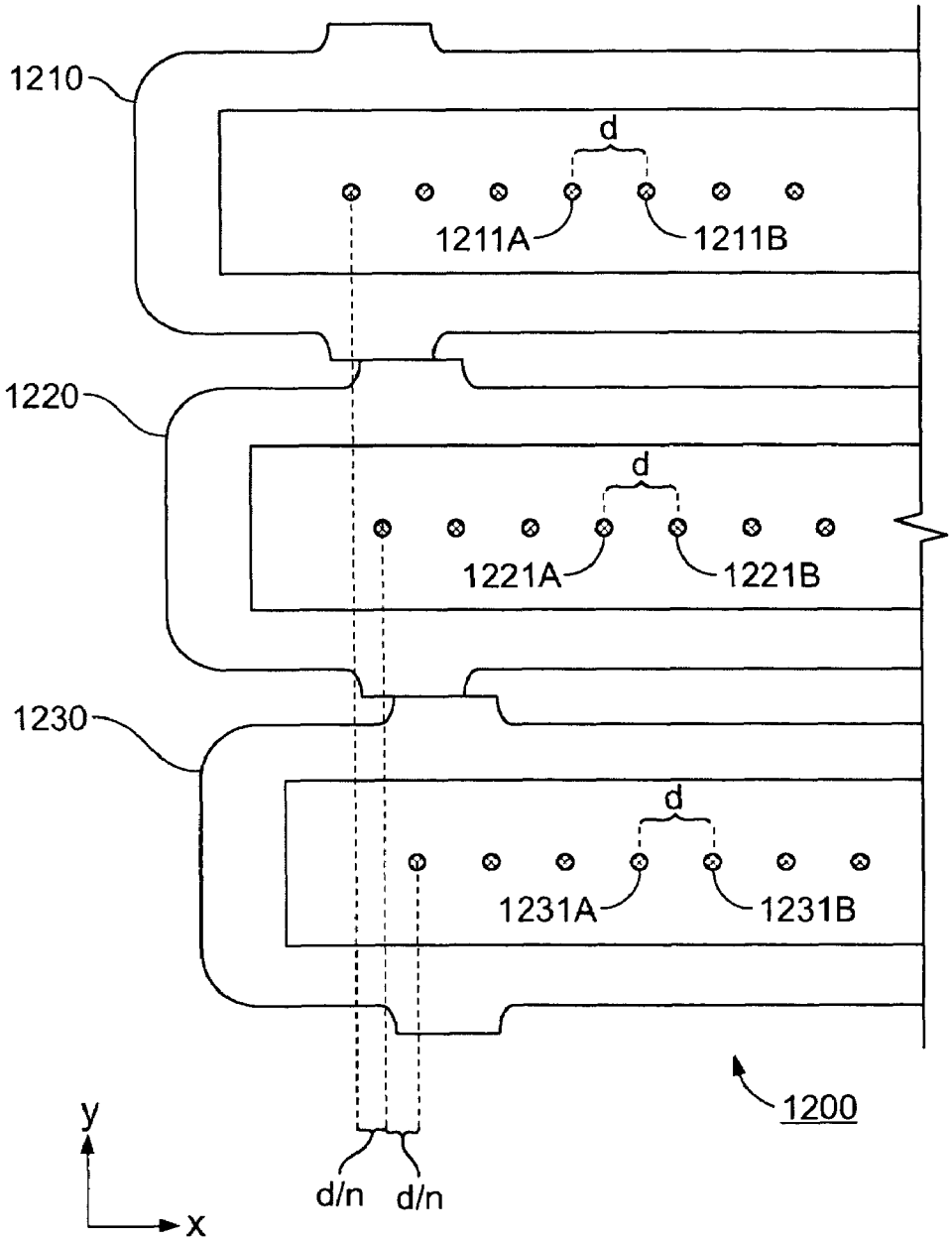
FIG. 11D is a diagram showing nozzle spacing in a portion of an assembly that includes multiple printhead modules.

Another example of alignment datums that register printhead modules relative to two degrees of freedom are shown in FIG. 11C. In this example, a protruding alignment datum 1070 inserts into a recessed alignment datum 1080. Protruding alignment datum 1070 includes precision surfaces 1071 and 1072. Surface 1071 contacts surface 1081 of alignment datum 1080, registering the printhead module in the x-direction. Similarly, surface 1072 contacts surface 1082 of alignment datum 1080, registering the printhead module in the y-direction.

Stacking printhead modules in a compact 2-D jetting array can reduce the dimensions over which precision should be maintained in any given part. Since the arrays are modular and can share common ink ports and temperature control, the size, cost, and complexity of the system can be reduced relative to systems in which individual jetting assemblies are each served by their own ink supply, temperature controller, and/or are individually mounted. Furthermore, individual printhead modules can be replaced should they become defective instead of replacing an array.

A number of embodiments of the invention have been described. Nevertheless, it will be understood that various modifications may be made without departing from the spirit and scope of the invention. Accordingly, other embodiments are within the scope of the following claims.

What is claimed is:

1. An assembly for depositing droplets on a substrate during relative motion of the assembly and the substrate along a process direction, the assembly comprising:

a printhead module that includes an array of nozzles through which the printhead module can eject droplets;

a frame configured to expose the the nozzle array; and a piezoelectric actuator mechanically coupled to the frame and the printhead module;

the piezoelectric actuator being activated to dither the printhead module with respect to the frame along a direction other than the process direction;

wherein the piezoelectric actuator is activated to dither the printhead module at a frequency different from a jetting frequency at which the droplets are jetted.

2. The assembly of claim 1, wherein the axis is orthogonal to the process direction.

3. The assembly of claim 1, wherein the axis is parallel to the array of nozzles.

4. The assembly of claim 1, wherein the piezoelectric actuator comprises a stack of layers of a piezoelectric material.

5. The assembly of claim 1, wherein the printhead module comprises a first alignment datum and the frame comprises a second alignment datum, the first and second alignment datums being matched with each other.

6. The assembly of claim 5 also including at least one additional printhead module each having a datum, the additional printhead module aligning with the printhead module and/or the frame along the process direction using the datums.

7. The assembly of claim 1 also including at least one additional printhead module having an actuator and interlacing with the printhead module, the actuator of the additional printhead and the piezoelectric actuator being configured to adjust the interlacing of the printhead modules during printing.

8. The assembly of claim 1, wherein the piezoelectric actuator has a dynamic range of about 5 microns to about 300 microns.

9. A method for jetting ink droplets on a substrate during relative motion along a process direction between the substrate and and assembly including a printhead module, a frame configured to expose a nozzle array of the printhead module, and a piezoelectric actuator coupled to the frame and the printhead module, the method comprising:

dithering the printhead module with respect to a frame on which the printhead is mounted along a direction other than the process direction using the piezoelectric actuator;

wherein the piezoelectric actuator is activated to dither the printhead module at a frequency different from a jetting frequency at which the droplets are jetted.

10. The method of claim 9 comprising aligning a datum on the printhead module with a datum on the frame before the dithering.

11. The method of claim 9 comprising dithering at a frequency different from a frequency at which the ink droplets are jetted.

12. The method of claim 9 comprising dithering at a frequency less than a frequency at which the ink droplets are jetted.

13. The method of claim 12, wherein the dithering frequency is about 0.1 times the ink jetting frequency.

14. The method of claim 12, wherein the dithering frequency is about 0.01 times the ink jetting frequency.

15. The method of claim 9 comprising dithering a distance that is a fraction of a pixel.

16. The method of claim 15, wherein the fraction is 1/2.

17. The method of claim 9 also including dithering the printhead module with respect to additional printhead modules that interlace with the printhead module.

18. The assembly of claim 1, further comprising an electronic controller configured to activate the piezoelectric actuator.

19. The assembly of claim 1, wherein the piezoelectric actuator is activated to dither the printhead module at a dither frequency that is comparable or higher than a jetting frequency, but the dither frequency is not equal to a jetting frequency at which the droplets are jetted or harmonics of the jetting frequency.

20. The assembly of claim 1, wherein the piezoelectric actuator is activated to dither the printhead module at a frequency less than a jetting frequency at which the droplets are jetted.

21. The assembly of claim 20, wherein the dithering frequency is about 0.1 times the jetting frequency.

22. The assembly of claim 20, wherein the dithering frequency is about 0.01 times the jetting frequency.

23. The assembly of claim 1, wherein the piezoelectric actuator is activated to dither the printhead module a distance that is a fraction of a pixel.

24. The assembly of claim 23, wherein the fraction is 1/2.

25. The assembly of claim 1, wherein the piezoelectric actuator is activated to dither the printhead module with respect to additional printhead modules that interlace with the printhead module.

26. The assembly of claim 1, wherein the piezoelectric actuator is activated to both vary the position of the printhead module to align the array of nozzles with respect to an axis of the assembly and to dither the printhead module with respect to the frame along a direction other than the process direction.

27. The method of claim 9 comprising varying the position of the printhead module with respect to an axis of the assembly using the piezoelectric actuator.

* * * * *

UNITED STATES PATENT AND TRADEMARK OFFICE

CERTIFICATE OF CORRECTION

PATENT NO. : 7,665,815 B2
APPLICATION NO. : 11/118293
DATED : February 23, 2010
INVENTOR(S) : David A. Swett It is certified that error appears in the above-identified patent and that said Letters Patent is hereby corrected as shown below:

Column 15, Line 35, in Claim 1:
after "expose" delete "the".

Column 16, Line 3, in Claim 9:
before "assembly" delete "and" and insert -- an --, therefor.

Signed and Sealed this

Twenty-ninth Day of June, 2010

David J. Kappos

David J. Kappos
*Director of the United States Patent and Trademark Office*